US007823748B2

(12) United States Patent
Yuyama et al.

(10) Patent No.: US 7,823,748 B2
(45) Date of Patent: Nov. 2, 2010

(54) DRUG DISPENSER AND DRUG FILLING APPARATUS INCORPORATING THE SAME

(75) Inventors: Shoji Yuyama, Toyonaka (JP); Hiroyuki Yuyama, Toyonaka (JP); Hiroshi Hashimoto, Toyonaka (JP); Katsunori Yoshina, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 849 days.

(21) Appl. No.: 10/566,162

(22) PCT Filed: May 13, 2004

(86) PCT No.: PCT/JP2004/006450

§ 371 (c)(1),
(2), (4) Date: Jun. 22, 2006

(87) PCT Pub. No.: WO2005/011563

PCT Pub. Date: Feb. 10, 2005

(65) Prior Publication Data

US 2006/0243738 A1 Nov. 2, 2006

(30) Foreign Application Priority Data

Jul. 31, 2003 (JP) ..... 2003-284555

(51) Int. Cl.
*G07F 11/00* (2006.01)

(52) U.S. Cl. ..... 221/174; 221/248; 221/249; 221/204; 221/195; 222/386; 222/326

(58) Field of Classification Search ..... 221/95, 221/174, 195, 204, 249, 248, 257, 279; 222/326, 222/386, 333
See application file for complete search history.

(56) References Cited

U.S. PATENT DOCUMENTS 1,342,456 A * 6/1920 Nagel ..... 222/318

(Continued)

FOREIGN PATENT DOCUMENTS

EP 1 053 738 11/2000

(Continued)

OTHER PUBLICATIONS

International Preliminary Report on Patentability, with English translation, issued Apr. 13, 2006 in connection with International Application No. PCT/JP2004/006450.

*Primary Examiner*—Timothy R Waggoner
(74) *Attorney, Agent, or Firm*—Wenderoth, Lind & Ponack, L.L.P.

(57) ABSTRACT

A drug filling apparatus capable of preventing drugs from being bridged to each other and reducing troubles. The drug filling apparatus functions to select specific tablets from various types of tablet groups and fill the selected tablets into a vial, and includes a storage cabinet, a drug supplying section, a drug halting section, a drug conveying section, a drug filling section, a vial storing section, and a vial carrying section. A drug dispenser is installed in the drug halting section. A receptacle of the drug dispenser is constituted by an outer receptacle portion and an inner receptacle portion. When a time for filling of tablets in the drug dispenser into the vial comes, a motor of a drive section rotates according to specified signals to rotate the inner receptacle portion; that is, the rotational orientation of the inner receptacle portion is changed to reverse the inner receptacle portion.

26 Claims, 26 Drawing Sheets

U.S. PATENT DOCUMENTS

| | | | | | |
|---|---|---|---|---|---|
| 1,438,595 | A | * | 12/1922 | Hale | 222/192 |
| 2,532,698 | A | * | 12/1950 | Corkins | 222/139 |
| 4,544,082 | A | | 10/1985 | Becker | |
| 5,348,061 | A | * | 9/1994 | Riley et al. | 221/133 |
| 5,437,393 | A | * | 8/1995 | Blicher et al. | 222/77 |
| 5,647,508 | A | | 7/1997 | Ronci et al. | |
| 6,119,892 | A | | 9/2000 | Laurent et al. | |
| 6,170,230 | B1 | * | 1/2001 | Chudy et al. | 53/168 |
| 6,471,090 | B1 | | 10/2002 | Inamura et al. | |

FOREIGN PATENT DOCUMENTS

| | | |
|---|---|---|
| JP | 53-57675 | 5/1978 |
| JP | 58-47728 | 3/1983 |
| JP | 59-103814 | 6/1984 |
| JP | 10-310195 | 11/1998 |
| JP | 11-276554 | 10/1999 |
| JP | 2000-103402 | 4/2000 |
| JP | 2001-129060 | 5/2001 |
| JP | 2002-240806 | 8/2002 |

* cited by examiner

DRUG DISPENSER AND DRUG FILLING APPARATUS INCORPORATING THE SAME

TECHNICAL FIELD

The present invention relates to a drug filling apparatus used for filling of oral solid drugs such as tablets, pills, and capsules into a container such as a vial or a bottle or wrapping materials such as a sachet. The present invention also relates to a drug dispenser desired to be incorporated in a device such as the drug filling apparatus.

BACKGROUND ART

A main service of drugstores is to select drugs or medicines from many types of stocked drugs according to a doctor's prescription and to provide the selected drugs to patients. Conventionally, this kind of work has been done by hand whereby pharmacists have taken out drugs while looking through the prescription.

However, the selection of drugs by hand involves troublesome tasks, so automation has been desired. Especially in large hospitals or the like, it would take considerable time to receive drugs after examination because of crowded drugstores, and thus, an improvement has been desired.

Therefore, the inventors formerly developed devices capable of automatically selecting and filling of drugs, and filed patent applications listed below.

Patent Document 1: JP 2001-130504 A

Patent Document 2: JP 2001-287702 A

Patent Document 3: JP 2001-294305 A

Patent Document 4: JP 2002-29501 A

Patent Document 5: JP 2002-29511 A

Drug filling apparatuses disclosed in the above-mentioned patent documents each include a prescription ordering section, a drug supplying section, a drug halting section, a drug conveying section, and a drug filling section. A drug dispenser is incorporated in the drug halting section.

The apparatuses described above send out a predetermined number of drugs from the drug supplying section to temporarily accumulate in a drug dispenser. Then, the drugs accumulated in the dispenser are sequentially conveyed via the drug conveying section to the drug filling section to fill the drugs in a container such as a vial.

More specifically, the prescription ordering section is a section inputting information of doctor's prescription. The drug supplying section has a plurality of drug feeders, in each of which a large drug storage receptacle storing drugs is attached.

The apparatuses described in the patent documents store various kinds of drugs in drug storage receptacles in the drug supplying section. Inputting of information of a prescription in the prescription ordering section operates the drug feeder corresponding to the predetermined drug storage receptacle to send out a predetermined number of drugs from the drug storage receptacle.

The drugs sent out are temporarily accumulated in the drug dispenser via a common passage.

Herein, the drug dispenser is provided with a shutter at its bottom. The closed shutter accumulates the drugs within the dispenser, whereas the opened shutter drops down the drugs at once into the drug conveying section of the next process. Then, as described above, the drug conveying section conveys the drugs to the drug filling section, so as to fill the drugs in a container such as a vial after confirmation of weight of the drugs.

The reason why drugs are conveyed by the drug conveying section after being temporarily accumulated in this way is that conveyance of drugs complete for the predetermined amount sequentially proceeds in parallel with a plurality of discharge of drugs because discharge of drugs from the drug supplying section requires much more time than other processes among those in filling drugs.

DISCLOSURE OF INVENTION

Object to be Solved by the Invention

The apparatuses described above have the drug dispenser, in which drugs are temporarily accumulated. Then, a predetermined signal opens the shutter to drop the drugs at once, thereby conveying the drugs to the next process.

The apparatuses described above perform the rate-determining process whereby drugs are discharged from the drug supplying section in parallel, thereby reducing wasted time in whole and requiring less time for process from inputting of information of a prescription to filling of drugs. That enables a reduction in waiting time of patients.

In this way, the apparatuses described above have an excellent performance, but the inventors have studied for many years so as to improve the performance and have examined possible failure or accident on the assumption of every situation.

The conclusion revealed that there is possibility of a bridge of drugs in the drug dispenser in the case of specific kinds or shape of drugs or adverse conditions such as high humidity.

Herein, the "bridge" is a phenomenon in which a plurality of drugs build an alignment between the opposite walls or the like, resulting in forming an arch. If and when the bridge of drugs is formed, a vertical force caused by drugs' own weight may be shared by adjacent drugs and be loaded onto the opposite walls or the like via the adjacent drugs. Consequently, the bridge of drugs may vertically stabilize drugs that constitute the bridge, and whereby the drugs cannot be dropped down.

The conventional apparatuses described above wherein a predetermined number of drugs are sent out from the drug feeder, temporarily accumulated in the drug dispenser, and dropped at once by opening the shutter, so as to convey the drugs to the next process, may form a bridge of the drugs in the drug dispenser, resulting in jammed drugs.

Though jamming of drugs resulting from the bridge may be found in examining gross weight of drugs in the last process as reduction of the weight, it may take a long time to restore the system, keeping patients waiting for a long period of time.

The present invention therefore aims to eliminate the possibility or worry described above and develops a drug dispenser such as preventing drugs from forming a bridge. The present invention also aims to develop a drug filling apparatus that prevents drugs from forming a bridge and reduces failures.

SUMMARY OF THE INVENTION

One of aspects of the present invention to solve the problems and drawbacks described above is to provide a drug dispenser to be positioned downstream of a drug feeder, the drug dispenser being adapted to receive solid drugs from the drug feeder, to temporarily accumulate the drugs, and to discharge the accumulated drugs, including a receptacle having an inner peripheral surface, an open top and a bottom adapted to be opened and closed, at least part of the inner peripheral surface being formed by a movable wall adapted to move when the bottom of the receptacle is opened.

In the drug dispenser in the present aspect, the receptacle has the movable wall at its inner peripheral surface, the movable wall moving in opening the bottom of the receptacle. Thus, a movement of the movable wall breaks a bridge. A bridge is a phenomenon in which a plurality of tablets are interposed between two walls, resulting in a failure to fall down. Herein, as the drug dispenser in the aspect has the movable wall at the inner peripheral wall of the receptacle, a bridge starting with the end of the movable wall is broken as the movable wall moves.

Many cases are considered as a mechanism in breaking a bridge. In the case that a number of drugs are accumulated in the drug dispenser to form a bridge at its intermediate part, for example, an end of the bridge moves as a movement of the movable wall, whereas drugs constituting the intermediate part of the bridge will maintain its halting state. More specifically, drugs constituting the bridge moves as the movable wall moves, but a number of other drugs not constituting the bridge try to remain in the present state. Thus, the drugs constituting the intermediate part of the bridge are prevented from moving to leave from drugs constituting the end of the bridge, and whereby the bridge is broken.

In the drug dispenser described above, the receptacle can have a substantially rectangular inner shape with longer sides and shorter sides as seen in a plan sectional view, the inner peripheral surface including a plurality of faces, at least one of the faces that form the longer sides being the movable wall.

The receptacle often has a plan sectional shape with longer sides and shorter sides such as a rectangular and an elongated hole-like shape due to limitations of its layout. The bridge is generally formed between the longer sides. That is why a bridge is seldom formed in the case that a distance between the walls is long because the bridge is unstable and why a bridge is frequently formed in the case that the distance is short. Thus, when a plan sectional shape is, for example, a rectangle, a bridge is formed between longer sides. Consequently, the present invention arranges the movable wall at one side or both sides of the peripheral wall constituting the longer sides.

In the drug dispenser described above, the movable wall can be adapted to rotate and have an arcuate portion.

The present aspect intends to design a larger movable wall. Specifically, as described above, as the present aspect divides the end of the bridge by moving a movable wall, it is preferable that the movable wall has the larger area. As the movable wall employed in the drug dispenser of the present aspect rotates, the movable wall does not change its location and moves remaining in the same location. The movable wall employed in the drug dispenser of the present aspect has an arcuate portion, so as to make a small rotating trajectory. Consequently, according to the present aspect, it is possible to design a larger movable wall and have a high efficiency for breaking a bridge.

In the drug dispenser described above, the movable wall can be situated around a position where the drugs are expected to be accumulated.

According to this structure, as the movable wall is situated around a position where drugs are expected to be accumulated, the movable wall is positioned at the end of a bridge when it has been formed, thereby having a high efficiency for breaking the bridge.

In the drug dispenser described above, the receptacle can include an outer receptacle portion and an inner receptacle portion accommodated in the outer receptacle portion, the outer receptacle portion having an opening at either of its top and bottom, the inner receptacle portion having an opening at one end thereof and a closure at the other end opposite to the one end and being invertible within the outer receptacle portion.

The drug dispenser in the present aspect has an outer receptacle and an inner receptacle portion that is accommodated in the outer receptacle portion. The outer receptacle portion has an opening at either of its top and bottom. The inner receptacle portion within the outer receptacle portion has an opening at one end thereof and has a closure at the other end thereof opposite to the one end.

The opening of the inner receptacle portion is faced upward so as to accumulate drugs, with the result that drugs sent out from the drug feeder enter the inner receptacle portion through the top opening of the outer receptacle and the opening of the inner receptacle portion. Herein, as the inner receptacle portion has the opening at one end but the closure at the other end opposite thereto, the bottom opening of the outer receptacle portion is closed by the closure. Thus, the drug dispenser has no opening at its bottom, and whereby drugs sent out from the drug feeder are accumulated in the inner receptacle portion.

The drug dispenser in the present aspect makes the inner receptacle portion to reverse within the outer receptacle portion so as to discharge drugs accumulated therein. As a consequence, the drugs accumulated in the inner receptacle portion fall down through the opening of the inner receptacle portion and are further discharged outside through the bottom opening of the outer receptacle portion.

At this time, even if a bridge has been formed in the inner receptacle portion, reversing changes a direction of pressure between the drugs, thereby breaking the bridge. Further, as well as the above-mentioned aspect, drugs constituting the bridge will move as the inner surface of the inner receptacle portion moves, whereas a number of other drugs not constituting the bridge will remain in the present location. That is because drugs constituting the intermediate part of the bridge are prevented from moving and leave from drugs constituting the end of the bridge to break the bridge.

Further, according to the present aspect, drugs having been situated at the bottom of the inner receptacle portion when the inner receptacle portion is in a positive rotational orientation move to be situated at an upper part of the bridge when the inner receptacle portion is reversed, so that the weight of the drugs having been situated at the bottom breaks the bridge.

In the drug dispenser described above, the receptacle can include an outer receptacle portion and an inner receptacle portion accommodated in the outer receptacle portion, the outer receptacle portion having an opening at either of its top and bottom and an arcuate portion at its inner surface, the inner receptacle portion having an outer surface in substantially conformity with the arcuate inner surface of the outer receptacle portion, the outer surface having an opening formed at a part thereof, the inner receptacle portion being rotatable within the outer receptacle portion, so that the outer surface of the inner receptacle portion closes the opening at the bottom of the outer receptacle portion when the inner receptacle portion is at a predetermined angular position and that the opening of the inner receptacle portion is in conformity with the opening of the outer receptacle portion when the inner receptacle portion is at another predetermined angular position.

The drug dispenser in the present aspect also has an outer receptacle portion and an inner receptacle portion that is accommodated in the outer receptacle portion. The outer receptacle portion has an opening at either of its top and bottom. The inner receptacle portion within the outer receptacle portion has an opening at one end thereof and has a closure at the other end thereof opposite to the one end. Further, the outer receptacle portion employed in the present aspect has an arcuate inner surface at lease at a part thereof, whereas the inner receptacle portion has an outer surface in substantially conformity with the arcuate inner surface of the outer receptacle portion. The inner receptacle portion also has an outer surface with an opening formed at a part thereof. The inner receptacle portion further rotates within the outer receptacle portion.

The opening of the inner receptacle portion is faced upward so as to accumulate drugs, with the result that drugs sent out from the drug feeder enter the inner receptacle portion through the top opening of the outer receptacle and the opening of the inner receptacle portion.

The drug dispenser in the present aspect makes the inner receptacle portion rotate within the outer receptacle portion to reverse its rotational orientation in order to discharge drugs accumulated therein. As a consequence, the drugs accumulated in the inner receptacle portion fall down through the opening of the inner receptacle portion and are further discharged outside through the bottom opening of the outer receptacle portion. According to the drug dispenser in the present aspect, as the outer receptacle portion has an arcuate inner surface and the inner receptacle portion has an outer surface in substantially conformity therewith, gap is seldom formed between the both surfaces when the inner receptacle portion rotates within the outer receptacle portion and drugs are hardly caught between the two surfaces.

The drug dispenser in the present aspect breaks a bridge when discharging drugs accumulated therein. Drugs having been situated at the bottom of the inner receptacle portion when the inner receptacle portion is in a positive rotational orientation move to be situated at an upper part of the bridge when the inner receptacle portion is reversed, so that the weight of the drugs having been situated at the bottom also breaks the bridge.

In the drug dispenser described above, it is preferable that the inner receptacle portion rotates around a substantially horizontal axis and makes at least one and a half rotations in discharging drugs.

When the inner receptacle portion reverses or rotates within the outer receptacle portion, like the above-mentioned drug dispenser, just one discharging process is unable to discharge all drugs even though the inner receptacle portion reverses or rotates when the drugs are filled to overflowing from the inner receptacle portion. Thus, the present aspect repeats the discharging process at least twice so as to prevent drugs from remaining.

A suitable aspect of an embodiment of the present invention is to provide a drug dispenser to be positioned downstream of a drug feeder, the drug dispenser being adapted to receive solid drugs from the drug feeder, to temporarily accumulate the drugs, and to discharge the accumulated drugs, including a receptacle having an opening at either of its top and bottom and a closing member accommodated in the receptacle, wherein the closing member is adapted to make 360 degrees rotation around a substantially horizontal axis, so that the closing member closes the bottom opening of the receptacle when being at a predetermined angular position and that the closing member leaves from the opening of the receptacle when being at another predetermined angular position.

The drug dispenser in the present aspect has a receptacle opening at either of its top and bottom. Further, the drug dispenser in the present aspect has a closing member, which rotates around a substantially horizontal axis. The closing member closes the bottom opening of the receptacle when being at a predetermined angular position.

According to the drug dispenser in the present aspect, the closing member is put in the predetermined angular position to close the bottom opening of the receptacle so as to accumulate drugs. As a consequence, drugs sent out from the drug feeder are accumulated in the receptacle.

According to the drug dispenser, the closing member is rotated to open the opening of the receptacle so as to discharge the drugs accumulated therein. Herein, the closing member makes 360 degrees rotation around the substantially horizontal axis, thereby scraping down a bridge even if the bridge has been formed.

Another suitable aspect as an embodiment of the present invention is to provide a drug dispenser to be positioned downstream of a drug feeder, the drug dispenser being adapted to receive solid drugs from the drug feeder, to temporarily accumulate the drugs, and to discharge the accumulated drugs, including a receptacle having an opening at either of its top and bottom and an arcuate portion at its inner surface, and a closing member accommodated in the receptacle, the closing member having an outer surface in substantially conformity with the arcuate inner surface of the receptacle, the closing member being rotatable within the outer receptacle portion in sliding contact with the arcuate inner surface, so that the closing member closes the bottom opening of the receptacle when being at a predetermined rotational position and that the closing member leaves from the opening of the receptacle when being at another predetermined rotational position.

The drug dispenser in the present aspect also has a receptacle opening at either of its top and bottom. Further, the drug dispenser in the present aspect has an arcuate inner surface at least at a part thereof, whereas the closing member has an outer surface in substantially conformity with the arcuate inner surface of the receptacle.

According to the drug dispenser in the present aspect, the closing member is put in the predetermined angular position to close the bottom opening of the receptacle so as to accumulate drugs. As a consequence, drugs sent out from the drug feeder are accumulated in the receptacle.

The closing member is rotated to open the opening of the receptacle in order to discharge drugs accumulated therein. In the drug dispenser in the present aspect, as the receptacle has the arcuate inner surface and the closing member has the outer surface in substantially conformity with the arcuate inner surface, gap is seldom formed between the both surfaces when the closing member rotates within the receptacle and drugs are hardly caught between the two surfaces. Even if a bridge has been formed, rotation of the closing member scrapes down the bridge.

Further, another aspect of the present invention is to provide a drug dispenser to be positioned downstream of a drug feeder, the drug dispenser being adapted to receive solid drugs from the drug feeder, to temporarily accumulate the drugs, and to discharge the accumulated drugs, including a receptacle having an opening at either of its top and bottom, a closing member for opening and closing the opening at the bottom of the receptacle, and a scraper adapted to cross within the receptacle when the closing member opens the opening at the bottom of the receptacle.

The drug dispenser in the present aspect also has a receptacle opening at either of its top and bottom. Further, the drug dispenser in the present aspect has a closing member, which opens and closes the bottom opening the receptacle. The closing member is put in a predetermined angular position to close the bottom opening of the receptacle so as to accumulate drugs.

According to the drug dispenser in the present aspect, when drugs accumulated therein are discharged, the closing member is open, and at this time, the scraper crosses within the receptacle. Thus, even if a bridge has been formed, the scraper divides part of the bridge to break the bridge.

In the case that the receptacle has longer sides and shorter sides in a plan sectional view, it is preferable that the scraper moves along the longer sides.

It is also preferable that the scraper crosses at part where drugs are expected to be accumulated.

It is preferable that the closing member is a linearly movable shutter, and that the scraper is integrated with the closing member and crosses within the receptacle in accordance with a movement of the closing member.

In the drug dispenser in the present aspect, as the scraper and the closing member are integrated with each other, the scraper simultaneously moves with the closing member, thereby crossing within the receptacle in accordance with a movement of the closing member to divide part of a bridge.

In the drug dispenser described above, it is possible that the closing member is a linearly movable shutter, and that the scraper has a sloping side and is integrated with the closing member, so as to cross within the receptacle with the sloping side facing forward in accordance with a linear movement of the closing member.

In the drug dispenser in the present aspect, the scraper crosses with the sloping side facing forward in accordance with a movement of the closing member, so as to break a bridge in such a way as raising drugs upon coming into contact with the bridge.

Further, another aspect of the present invention is to provide a drug dispenser to be positioned downstream of a drug feeder, the drug dispenser being adapted to receive solid drugs from the drug feeder, to temporarily accumulate the drugs, and to discharge the accumulated drugs, including a receptacle having an opening at either of its top and bottom, a closing member for opening and closing the opening at the bottom of the receptacle, and a scraper adapted to scrape a part of the inner surface of the receptacle or a vicinity of the part when the closing member opens the opening at the bottom of the receptacle.

The drug dispenser in the present aspect also has a receptacle opening at either of its top and bottom. Further, the drug dispenser in the present aspect has a closing member, which opens and closes the bottom opening the receptacle. The closing member is put in a predetermined angular position to close the bottom opening of the receptacle so as to accumulate drugs.

According to the drug dispenser in the present aspect, when drugs accumulated inside are discharged, the closing member is open, and at this time, the scraper scrapes a part of the inner surface of the receptacle or a vicinity of the part. Thus, even if a bridge has been formed, the scraper divides part of the bridge to scrape down the bridge.

In the case that the receptacle has longer sides and shorter sides in a plan sectional view, it is preferable that the scraper moves along the longer sides.

It is also preferable that the scraper crosses at part where drugs are expected to be accumulated.

It is desirable that the closing member is a linearly movable shutter and that the scraper is integrated with the closing member.

In the drug dispenser described above, the receptacle can include an outer receptacle portion and an inner receptacle portion accommodated in the outer receptacle portion, the outer receptacle portion having an opening at either of its top and bottom, the inner receptacle portion having an opening at one end thereof, a closure at the other end opposite to the one end, a closing member for opening and closing the opening at the bottom thereof, and a scraper adapted to scrape the inner surface of the outer receptacle portion in accordance with rotation of the inner receptacle portion.

In the drug dispenser described above, the scraper can have a non-circular shape and be adapted to rotate along the inner surface of the outer receptacle portion.

Further, in the drug dispenser described above, the receptacle can include an outer receptacle portion and an inner receptacle portion accommodated in the outer receptacle portion, the outer receptacle portion having an opening at either of its top and bottom, the inner receptacle portion being rotatable within the outer receptacle portion and having an opening at one end thereof, a closure at the other end opposite to the one end, a closing member for opening and closing the opening at the bottom of the outer receptacle portion, and a scraper having an arm shape and being rotatable along the inner surface of the outer receptacle portion.

According to this structure, even if a bridge has been formed within the receptacle, the scraper divides part of the bridge to prevent the bridge from remaining within the receptacle.

The drug dispenser described above can further include a casing accommodating the receptacle, an engaging portion normally protruding from and capable of being retracted into the casing, and a pressing portion for pressing the engaging portion into the casing, so that the engaging portion is retracted into the casing when the pressing portion is pressed.

The drug dispenser in the present aspect employs a structure for facilitating to install in and remove from an apparatus such as a drug filling apparatus when being employed as a part of such apparatus.

Further, another aspect of the present invention is to provide a drug filling apparatus including a drug supplying section provided with a plurality of drug feeders adapted to send out solid drugs, the drug dispenser as described above adapted to temporarily accumulate the drugs sent out from the drug feeder and to discharge the accumulated drugs, and a drug filling section adapted to fill the drugs discharged from the drug dispenser into a predetermined container or wrapping materials.

The present aspect applies the above-mentioned drug dispenser to a drug filling apparatus.

Further another aspect of the present invention is to provide a drug filling apparatus including a plurality of drug feeders vertically and horizontally arranged in a matrix, a plurality of common passageways each corresponding to at least one column of the drug feeders, the drug dispenser as described above positioned downstream of each of the common passageways, and a drug filling section adapted to fill the drugs discharged from the drug dispenser.

The present aspect also applies the above-mentioned drug dispenser to a drug filling apparatus. In the drug filling apparatus in the present aspect, a plurality of drug feeders are vertically and horizontally arranged in a matrix, and a plurality of common passageways each corresponding to at least one column of the drug feeders are formed, the drug dispenser being positioned downstream of each of the common passageways.

Drugs sent out from the drug feeder drop down the common passageway to have an impact on drugs having already dropped, so as to pack them. Therefore, there is possibility to form a bridge of drugs, but the drug dispenser employed in the present aspect has a function of breaking or collapsing the bridge, thereby discharging every last drug accumulated in the drug dispenser to the next process.

Further, another aspect of the present invention is to provide a drug filling apparatus including a main body, a plurality of drug feeders adapted to send out solid drugs and arranged vertically and horizontally in a matrix in the main body, a plurality of common passageways each corresponding to at least one column of the drug feeders, a drug dispenser positioned downstream of each of the common passageways, the drug dispenser being adapted to receive solid drugs from the drug feeder, to temporarily accumulate the drugs, and to discharge the accumulated drugs through its predetermined opening, and a drug filling section adapted to fill the drugs discharged from the drug dispenser into a predetermined container or wrapping materials, wherein the drug dispenser comprises a receptacle, a power source and a casing accommodating the receptacle and the power source integrally, the receptacle being adapted to accumulate the drugs, the power source being adapted to open an opening of the receptacle, wherein the drug dispenser further comprises an engaging portion normally protruding from and capable of being retracted into the casing, and a pressing portion for pressing the engaging portion into the casing, so that the engaging portion is retracted into the casing when the pressing portion is pressed, and wherein the main body has a plurality of compartments for installing the casing of the drug dispenser therein, the compartment having an engaging hole or a slot, so as to install the drug dispenser in the compartment with the pressing portion of the drug dispenser pressed to make the engaging portion retracted into the casing, the engaging portion being engaged with the engaging hole or the slot formed in the compartment.

In the drug dispenser in the present aspect, a plurality of drug feeders are vertically and horizontally arranged in a matrix and a plurality of common passageways each corresponding to at least one column of the drug feeders are formed, the drug dispenser being positioned downstream of each of the common passageways.

Herein, the drug dispenser employed in the present aspect includes a casing adapted to accommodate a receptacle and a power source integrally, the receptacle being adapted to accumulate the drugs, the power source being adapted to open an opening of the receptacle. Further, there is provided with an engaging portion normally protruding from and capable of being retracted into the casing, and a pressing portion for pressing the engaging portion into the casing, so that the engaging portion is retracted into the casing when the pressing portion is pressed.

In the drug filling apparatus in the present aspect, the main body has a plurality of compartments for installing the casing of the drug dispenser therein, the compartment having an engaging hole or a slot.

The drug filling apparatus in the present aspect inserts the drug dispenser into the compartment with the pressing portion of the drug dispenser pressed to make the engaging portion retracted into the casing. Then, the pressure to the pressing portion is released to protrude the engaging portion out of the casing, so that the engaging portion is engaged with the engaging hole or the slot formed in the compartment.

Further, the drug filling apparatus described above can have such a structure that the casing has a casing connector at its distal end and the main body has a main body connector in the compartment thereof, the engagement hole or the slot extending in a longitudinal direction of the casing, so that the casing connector and the main body connector are connected by sliding the casing with the engaging portion engaged with the engaging hole or the slot in the compartment.

The drug filling apparatus in the present aspect intends to electrically connect simultaneously with installing the drug dispenser in the main body.

In the present aspect, the casing has a casing connector at its distal end and the main body has a main body connector in the compartment thereof. In the drug filling apparatus in the present aspect, the engagement hole or the slot extends in a longitudinal direction of the casing, so that the casing connector and the main body connector are connected by sliding the casing with the engaging portion engaged with the engaging hole or the slot in the compartment.

ADVANTAGEOUS EFFECT OF THE INVENTION

Further, another aspect of the present invention is to provide a drug dispenser to be positioned downstream of a drug feeder, the drug dispenser being adapted to receive solid drugs from the drug feeder, to temporarily accumulate the drugs, and to discharge the accumulated drugs, including a receptacle having an open top and a bottom adapted to be opened and closed, wherein the receptacle includes an outer receptacle portion and an inner receptacle portion accommodated in the outer receptacle portion, the outer receptacle portion having an opening at either of its top and bottom, the inner receptacle portion having an opening at one end thereof and a closure at the other end opposite to the one end and being invertible within the outer receptacle portion.

Another aspect of the present invention is to provide a drug dispenser to be positioned downstream of a drug feeder, the drug dispenser being adapted to receive solid drugs from the drug feeder, to temporarily accumulate the drugs, and to discharge the accumulated drugs, including a receptacle having an opening at either of its top and bottom, a closing member for opening and closing the opening at the bottom of the receptacle, and a scraper integrated with the closing member and adapted to cross within the receptacle when the closing member opens the opening at the bottom of the receptacle.

Further, another aspect of the present invention is to provide a drug dispenser to be positioned downstream of a drug feeder, the drug dispenser being adapted to receive solid drugs from the drug feeder, to temporarily accumulate the drugs, and to discharge the accumulated drugs, including a receptacle having an opening at either of its top and bottom, wherein the receptacle includes an outer receptacle portion and an inner receptacle portion accommodated in the outer receptacle portion, the outer receptacle portion having an opening at either of its top and bottom, the inner receptacle portion having an opening at one end thereof, a closure at the other end opposite to the one end, a closing member for opening and closing the opening at the bottom of the outer receptacle portion, and a scraper having an arm shape, integrated with the closing member, and adapted to scrape the inner surface of the outer receptacle portion in accordance with a rotation of the inner receptacle portion.

Further, another aspect of the present invention is to provide a drug dispenser to be positioned downstream of a drug feeder, the drug dispenser being adapted to receive solid drugs from the drug feeder, to temporarily accumulate the drugs, and to discharge the accumulated drugs, including a receptacle having an opening at either of its top and bottom, a closing member for opening and closing the opening at the bottom of the receptacle, and a scraper integrated with the closing member and adapted to scrape a part of the inner surface of the receptacle or a vicinity of the part when the closing member opens the opening at the bottom of the receptacle.

The drug dispenser and the drug filling apparatus in the present invention have an advantageous effect in that no blocking of drugs and little failure occurs. That allows for not keeping patients waiting. Additionally, the drug filling apparatus has an advantageous effect for easy installation and removal of the drug dispenser, facilitating doing maintenance.

DETAILED DESCRIPTION OF THE INVENTION

Now, preferred embodiments of the present invention will be described below, making reference to the accompanying drawings.

Figure 1:
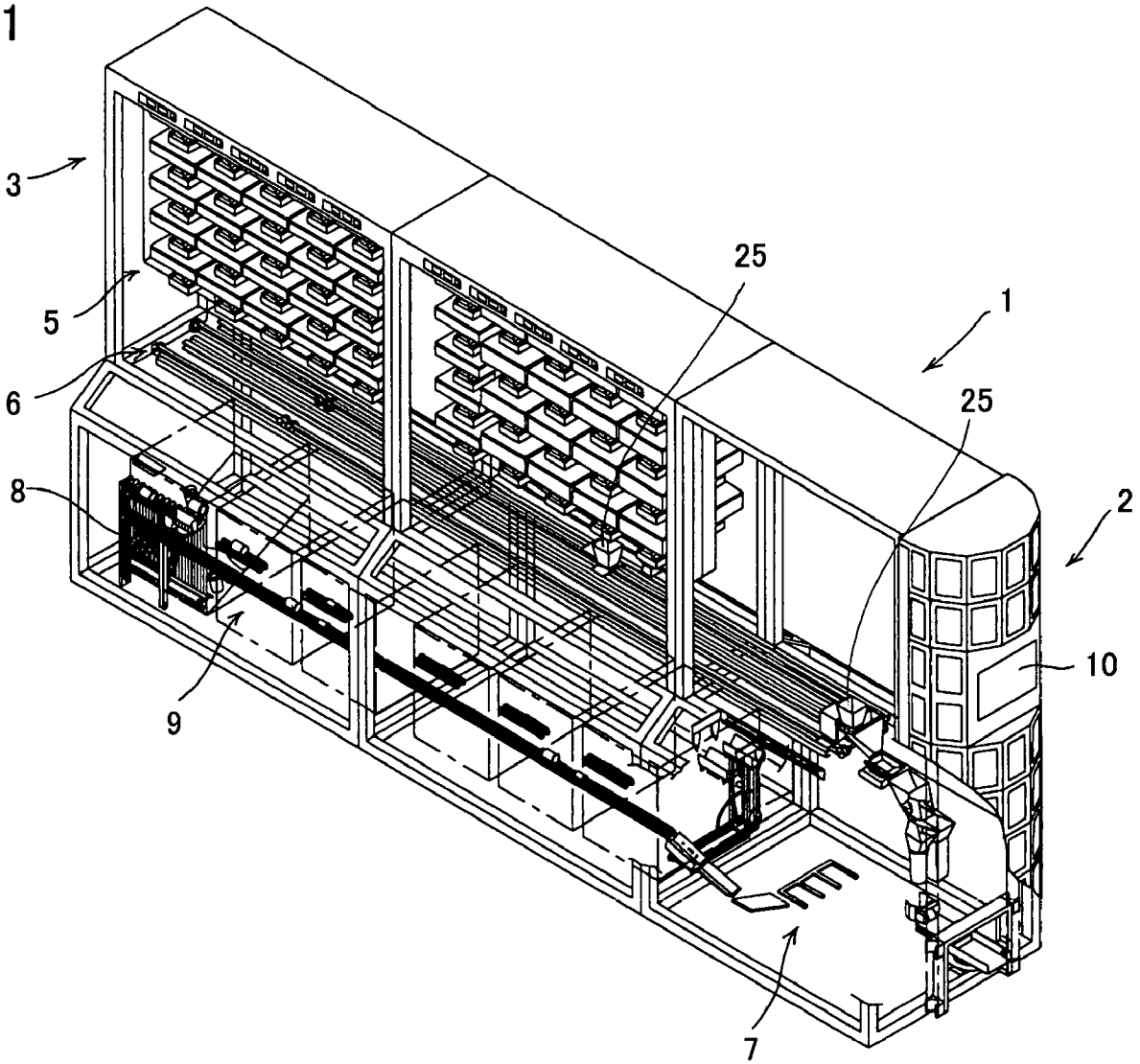
FIG. 1 is a perspective view of a drug filling apparatus embodying the present invention.
Figure 2:
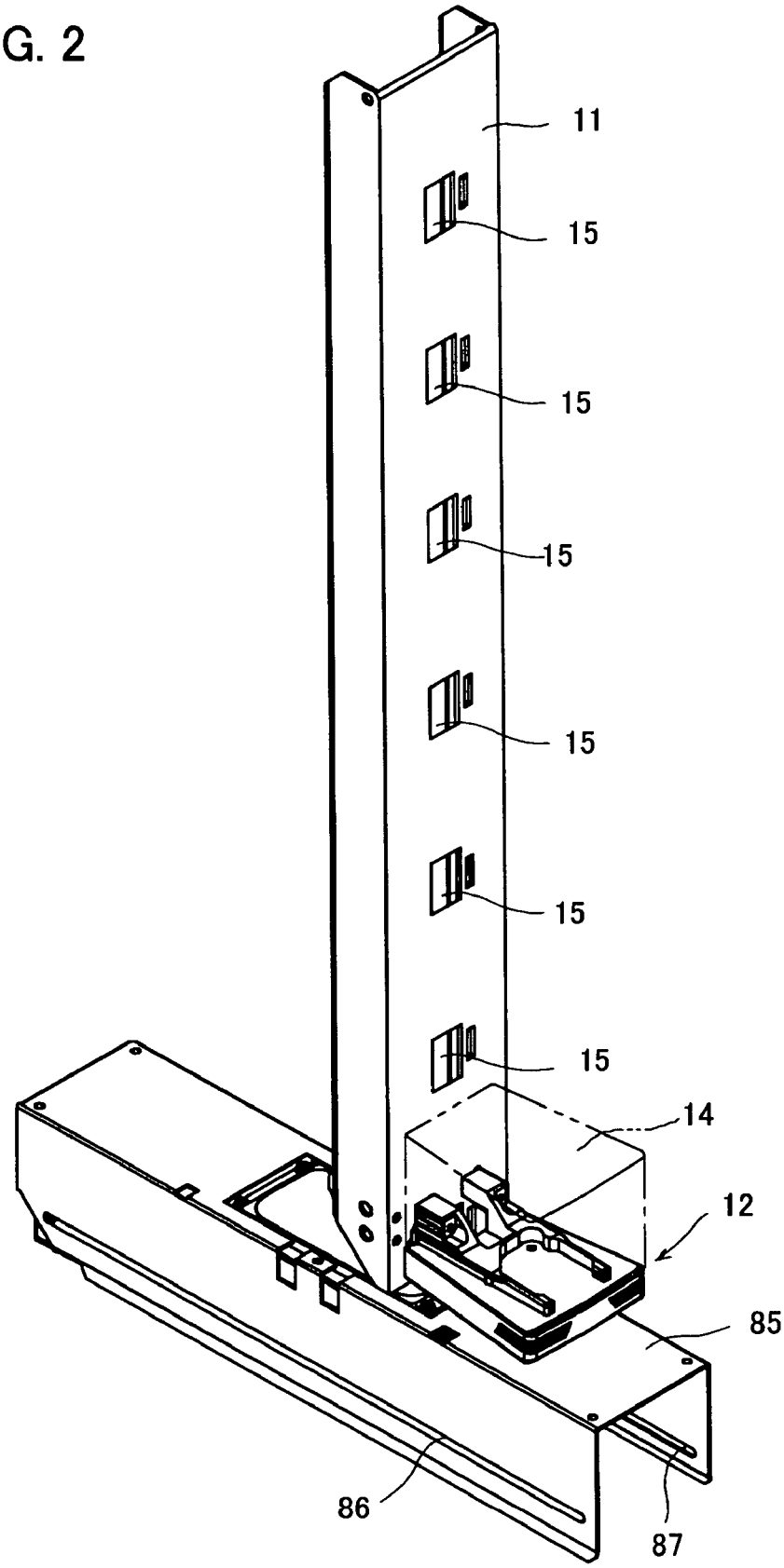
FIG. 2 is a perspective view of a common passageway of the drug filling apparatus shown in FIG. 1.
Figure 3:
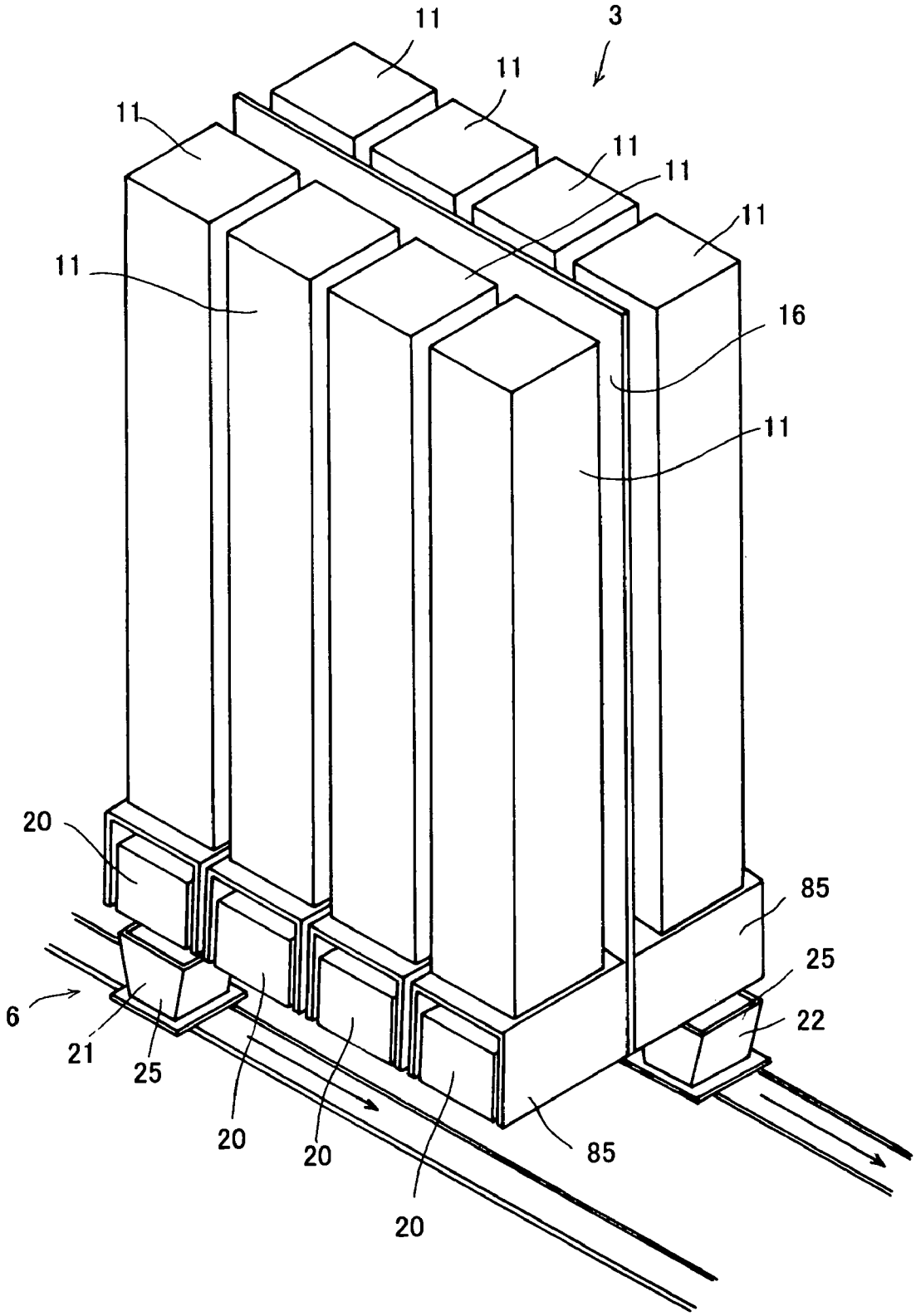
FIG. 3 is a schematic perspective view of a positional relationship among a drug supplying section, a drug dispensing section, and a drug conveying section of the drug filling apparatus shown in FIG. 1.
Figure 4:
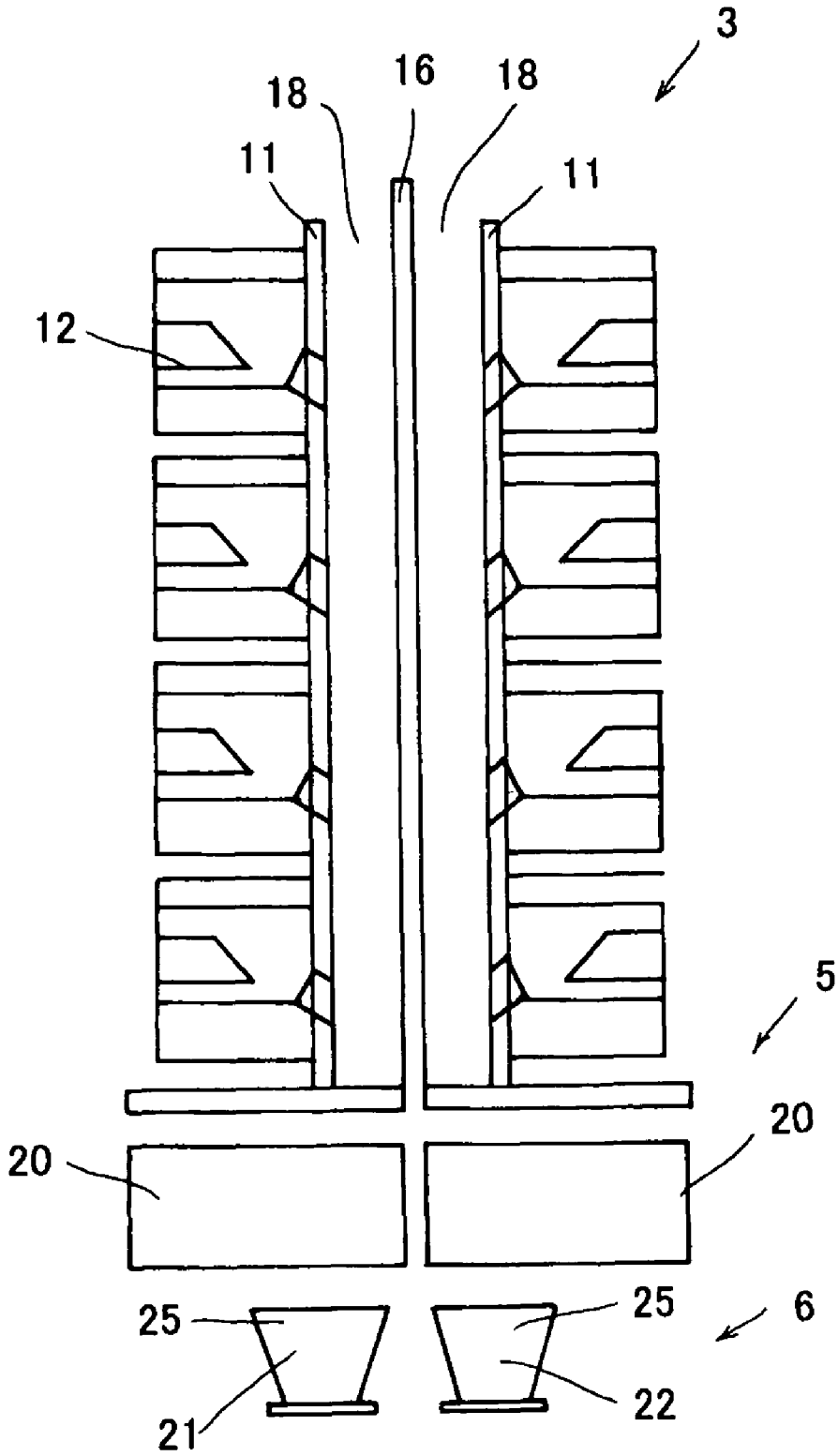
FIG. 4 is a cross-sectional view as taken along A-A of FIG. 3.

FIG. 1 is a perspective view of a drug filling apparatus embodying the present invention. FIG. 2 is a perspective view of a common passageway of the drug filling apparatus shown in FIG. 1. FIG. 3 is a schematic perspective view of a positional relationship among a drug supplying section, a drug dispenser, and a drug conveying section of the drug filling apparatus shown in FIG. 1. FIG. 4 is a cross-sectional view as taken along A-A of FIG. 3.

Referring to the figures, the reference numeral 1 denotes the drug filling apparatus in the preferred embodiment of the present invention.

The drug filling apparatus 1 in the embodiment is characterized by a drug halting section 5, though a description of the characteristic structure is preceded by a description of a structural outline and functions of the entire apparatus.

The drug filling apparatus 1 has functions of selecting specific tablets from various types of tablets and filling the selected tablets into a vial.

The drug filling apparatus 1 mainly consists of a storage cabinet 2, a drug supplying section 3, a drug halting section 5, a drug conveying section 6, a drug filling section 7, a vial storing section 8, a vial carrying section 9.

The storage cabinet 2 is used for temporarily placing vials into which tablets are filled. The storage cabinet 2 has an inputting means (prescription ordering section) including a touch panel 10 to input information such as a prescription, name of a patient, and age.

The drug supplying section 3 has a number of common passageway members 11 as shown in FIG. 2 arranged therein, each with a plurality of drug feeders 12.

More specifically, one common passageway member 11 has a channel shape as shown in FIG. 2 and has a plurality of through-holes 15. One drug feeder 12 is attached to one through-hole 15 (In FIG. 2, only the drug feeder in the lowest part is shown).

The common passageway members 11, as shown in FIGS. 3 and 4, are lined at both sides of a vertical wall 16.

More specifically, a number of common passageway members 11 are laterally lined each in a vertical position and with its concave portion facing to the surface of the vertical wall 16. By a front sight of the drug supplying section 3, the drug feeders 12 are vertically and horizontally arranged in a matrix. By a back sight of the drug supplying section 3, in the same way as a front sight, the drug feeders 12 are vertically and horizontally arranged in a matrix.

The common passageway members 11 each are a channel-like member as described above and are vertically arranged in parallel with the vertical wall 16, so as to form a cavity extending in a vertical direction between the inner surface of the common passageway member 11 and the surface of the vertical wall 16. This cavity functions as a common passageway 18.

As described, as the drug feeders 12 are attached to each of the common passageway member 11, one column of the drug feeders 12 belongs to one common passageway 18.

Drug storage receptacles 14 (two-dot chain line in FIG. 2) each are attached to the drug feeder 12, each of the drug storage receptacles 14 storing different kinds of tablets.

A plurality of drug dispensers 20, as shown in FIGS. 3 and 4, are disposed under the drug supplying section 3, thereby constituting a drug halting section 5.

The drug dispenser 20 essentially has functions of temporarily accumulating oral solid drugs and discharging them at once, although its structure and functions will be described in detail below.

One drug dispenser 20 is disposed at each of the common passageway 11.

A dug conveying section 6 is disposed under the drug halting section 5. In the present embodiment, the drug conveying section 6 consists of two conveyors 21 and 22, one conveyor 21 conveying tablets discharged from a group of the drug dispensers 20 aligned at the front side of the drug filling apparatus 1 and at the front side of the vertical wall 16.

On the other hand, the other conveyor 22 conveys tablets discharged from a group of the dispenser 20 aligned at the rear side of the drug filling apparatus 1 and at the rear side of the vertical wall 16.

Each of the conveyors 21 and 22 have a moving hopper 25 (also referred to as a conveyor vessel), which linearly moves with chained or belted up. More specifically, the conveyors 21 and 22 convey tablets discharged from the corresponding groups of the drug dispensers 20 toward a drug filling section 7 in accordance with a horizontal movement of the moving hoppers 25.

A vial storing section 8 stocks vials, or drug containers. A vial carrying section 9 is a small conveyor for carrying a vial picked out from the vial storing section 8 to the drug filling section 7.

Now, a basic operation of the drug filling apparatus 1 of the present embodiment is described below.

The drug filling apparatus 1 starts to operate with inputting into the touch panel 10. In the apparatus 1, tablets and a vial are separately conveyed to the drug filling section 7, and then the tablets are filled in the vial at the drug filling section 7.

Specifically, inputting of kinds of drugs by the touch panel 10 operates the drug feeders 12 having the drug storage receptacle 14 containing the drugs. The drug feeder 12 is, conventionally known, provided with a dispenser, a sensor, and a counter all not shown and picks out drugs one by one from the drug storage receptacle 14 to send them out to the common passageways 18. The drug feeders 12 each have the sensor and the counter as described above, whereby the number of tablets sent to the common passageways 18 is counted to make a halt when this number reaches the predetermined number.

The discharged tablets drop through the common passageway 18 one by one and are accumulated within the drug dispenser 20 of the drug halting section 5. Herein, since it takes a considerable time to send out drugs from the drug feeders 12, the drugs are sent out in parallel from the drug feeders 12. On the condition that there are 30 common passageways 18 numbered as first through 30th, in parallel with sending of drugs out from the drug feeders 12 belonging to the first common passageway 18, any drug feeder 18 belonging to one of the other 29 common passageways 18 sends out drugs through this common passageway 18. Drugs can be sent out through more than two common passageways 18 simultaneously.

Then, the moving hopper 25 of either of the conveyor 21 or 22 moves under the first drug dispenser 20 of the common passageway 18 in which the drug feeders 12 finish sending out drugs, whereupon the drug dispenser 20 operates to discharge the drugs accumulated in the drug dispenser 20 at once into the moving hopper 25 of the conveyor 21 or 22. Subsequently, as described above, the moving hopper 25 is conveyed toward the drug filling section 7.

In parallel with this operation, a vial is taken out from the vial storing section 8 to be conveyed to the drug filling section 7.

The drug filling section 7 measures weight of drugs conveyed by the moving hopper 25, and if there is nothing wrong with the result, the drugs are filled in the vial. Lastly, names of a patient and the drug are printed on the vial to complete a series of processes.

The structural outline and functions of the entire apparatus of the drug filling apparatus 1 is simply described above. The drug filling apparatus 1 in the embodiment is characterized by the drug halting section 5; especially the drug dispenser 20, the main device of the section, and these structures and effect are detailed below.

Figure 5:
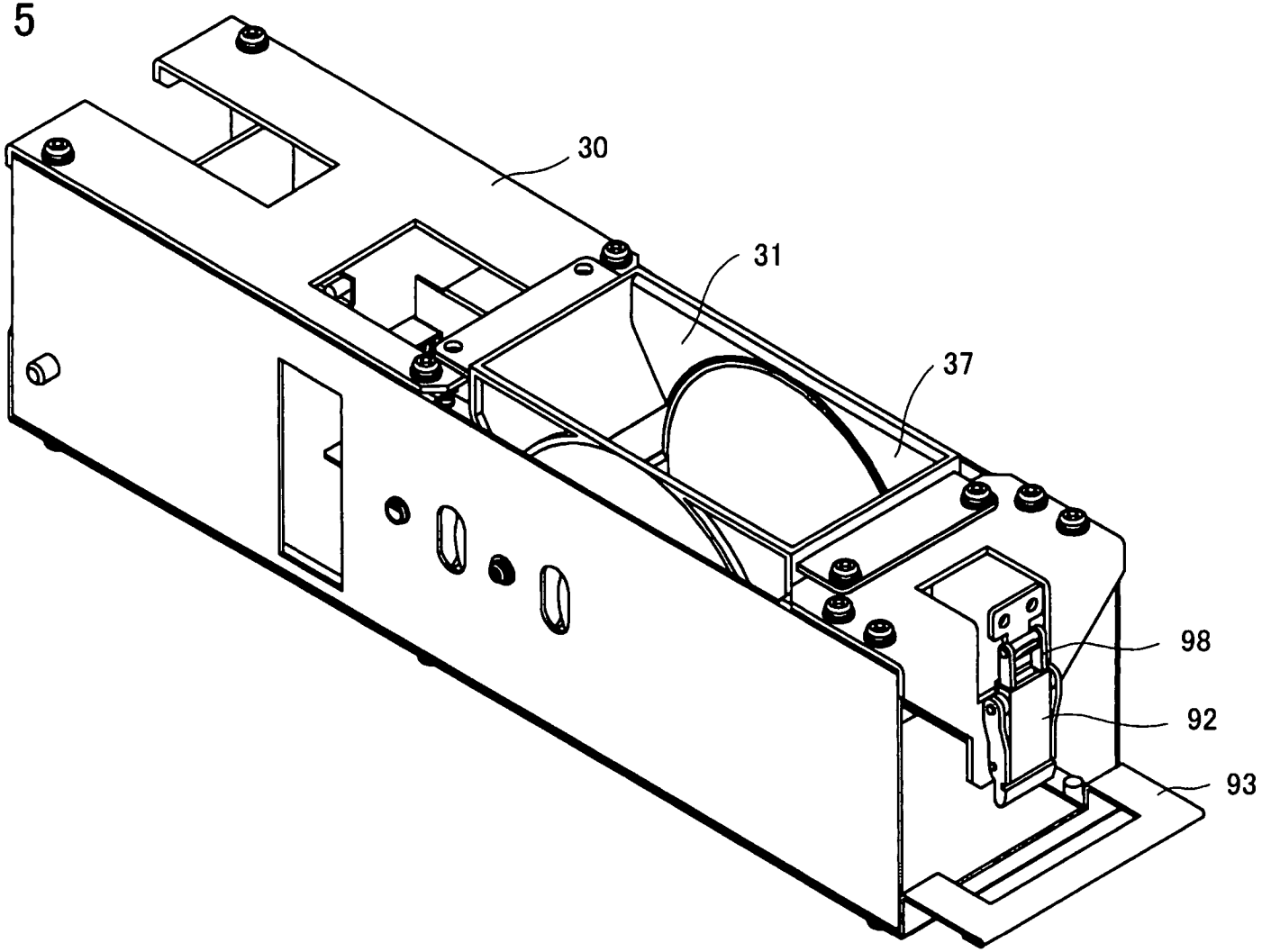
FIG. 5 is a perspective view of a drug dispenser embodying the present invention as seen from its rear end.
Figure 6:
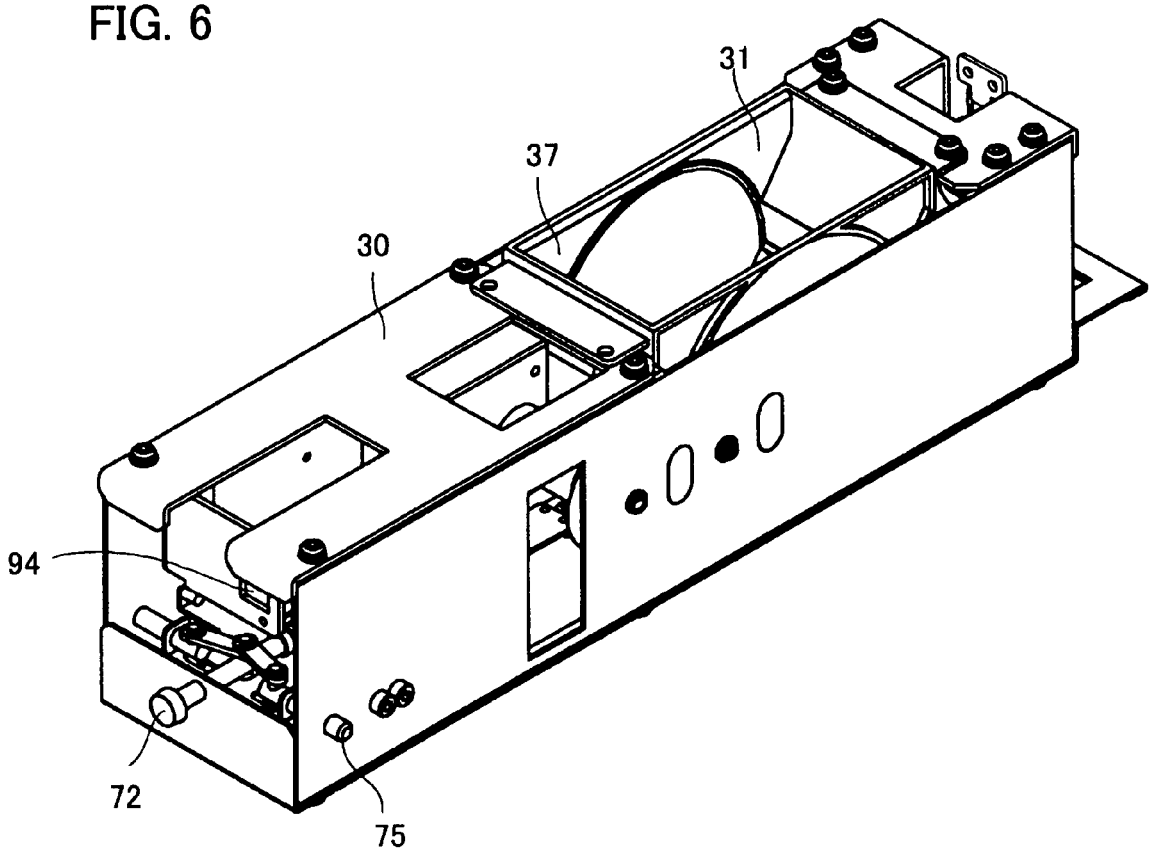
FIG. 6 is a perspective view of the drug dispenser embodying the present invention as seen from its front end.
Figure 7:
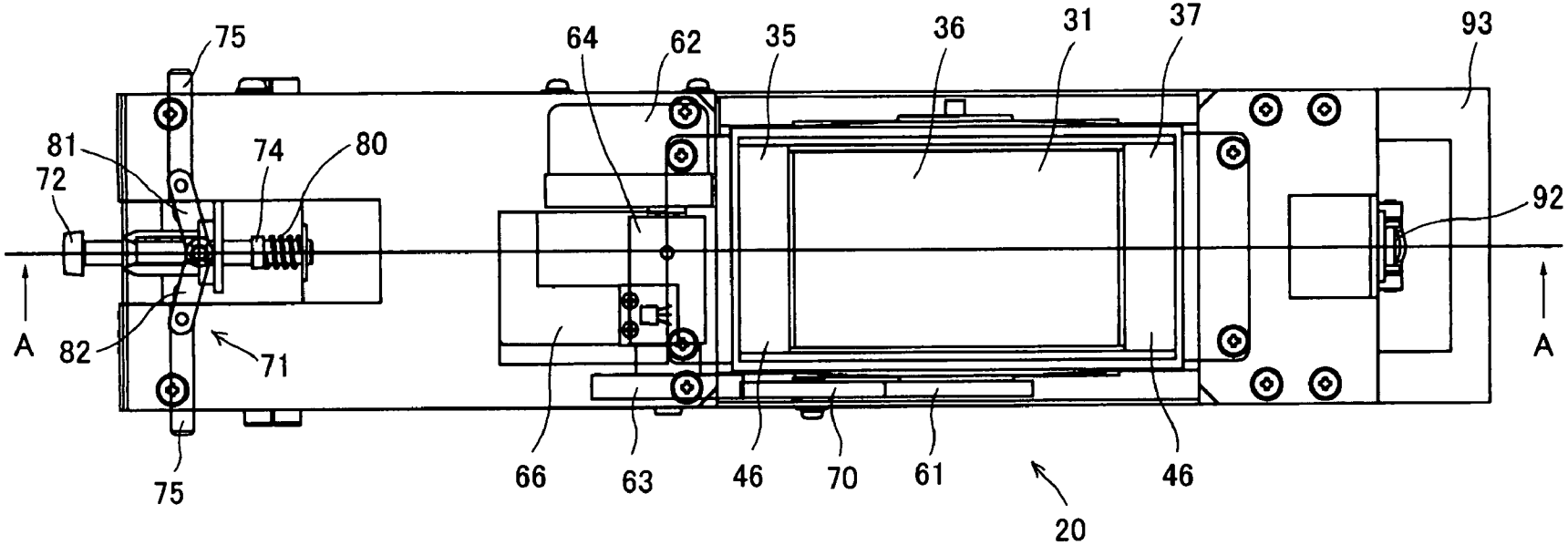
FIG. 7 is a plan view of the drug dispenser shown in FIG. 5.
Figure 8:
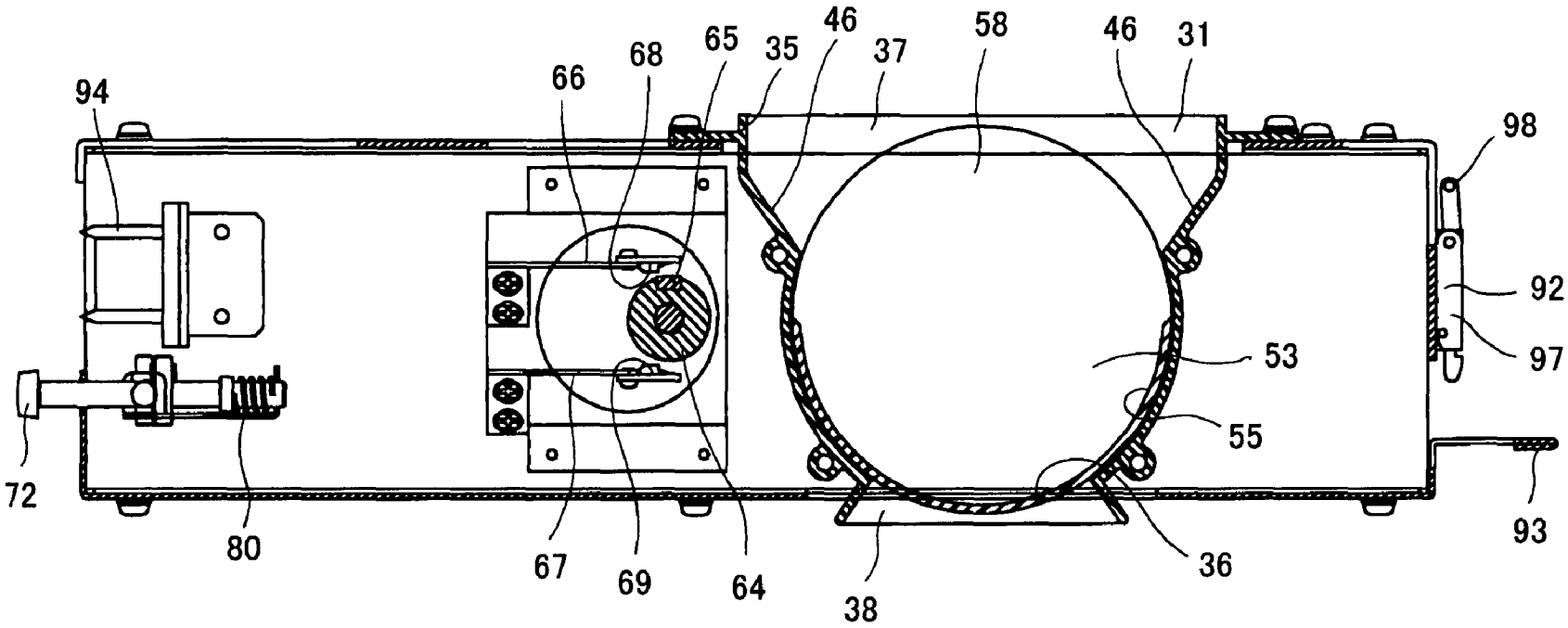
FIG. 8 is a cross-sectional view as taken along A-A of FIG. 7.
Figure 9:
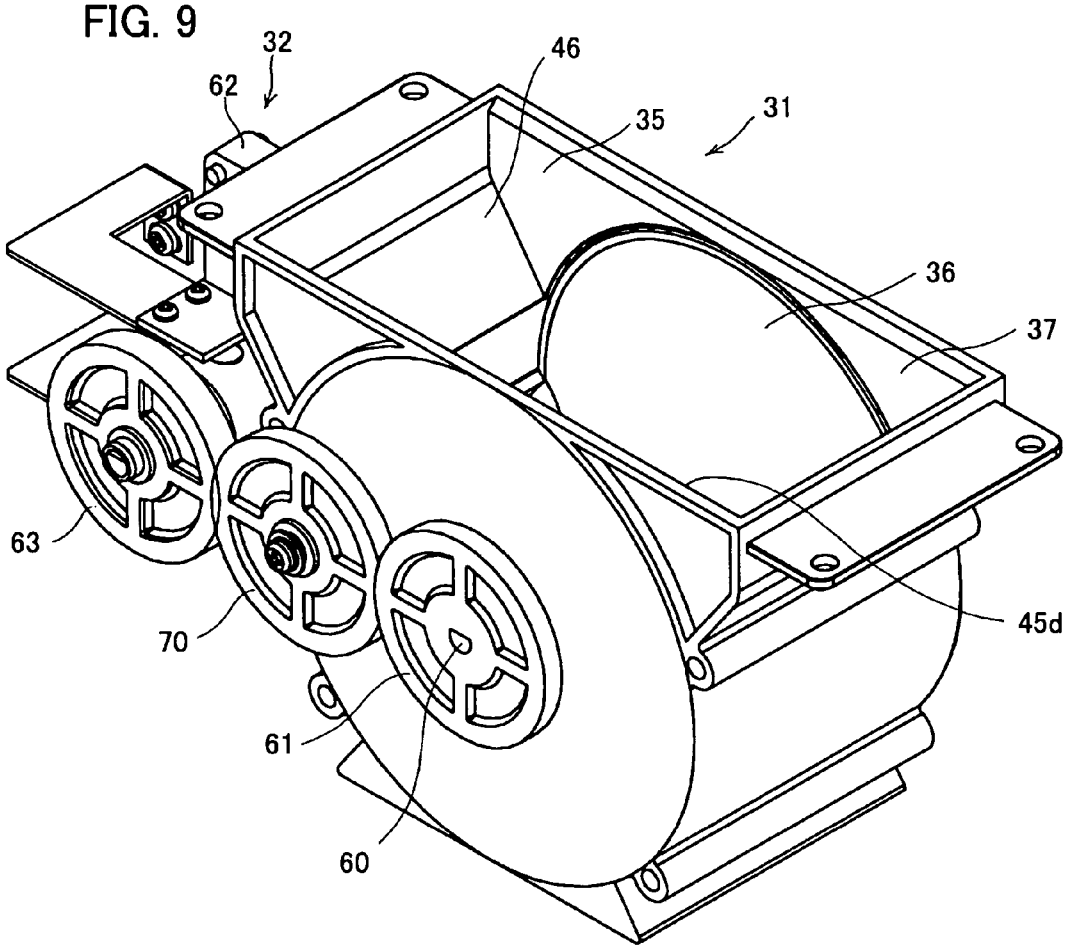
FIG. 9 is a perspective view of a receptacle and a driving section of the drug dispenser of FIG. 5.
Figure 10:
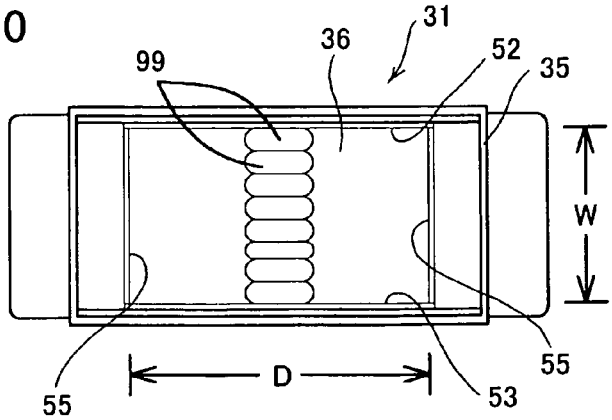
FIG. 10 is a plan sectional view of a central part of the drug dispenser of FIG. 5 with drugs bridged.
Figure 11:
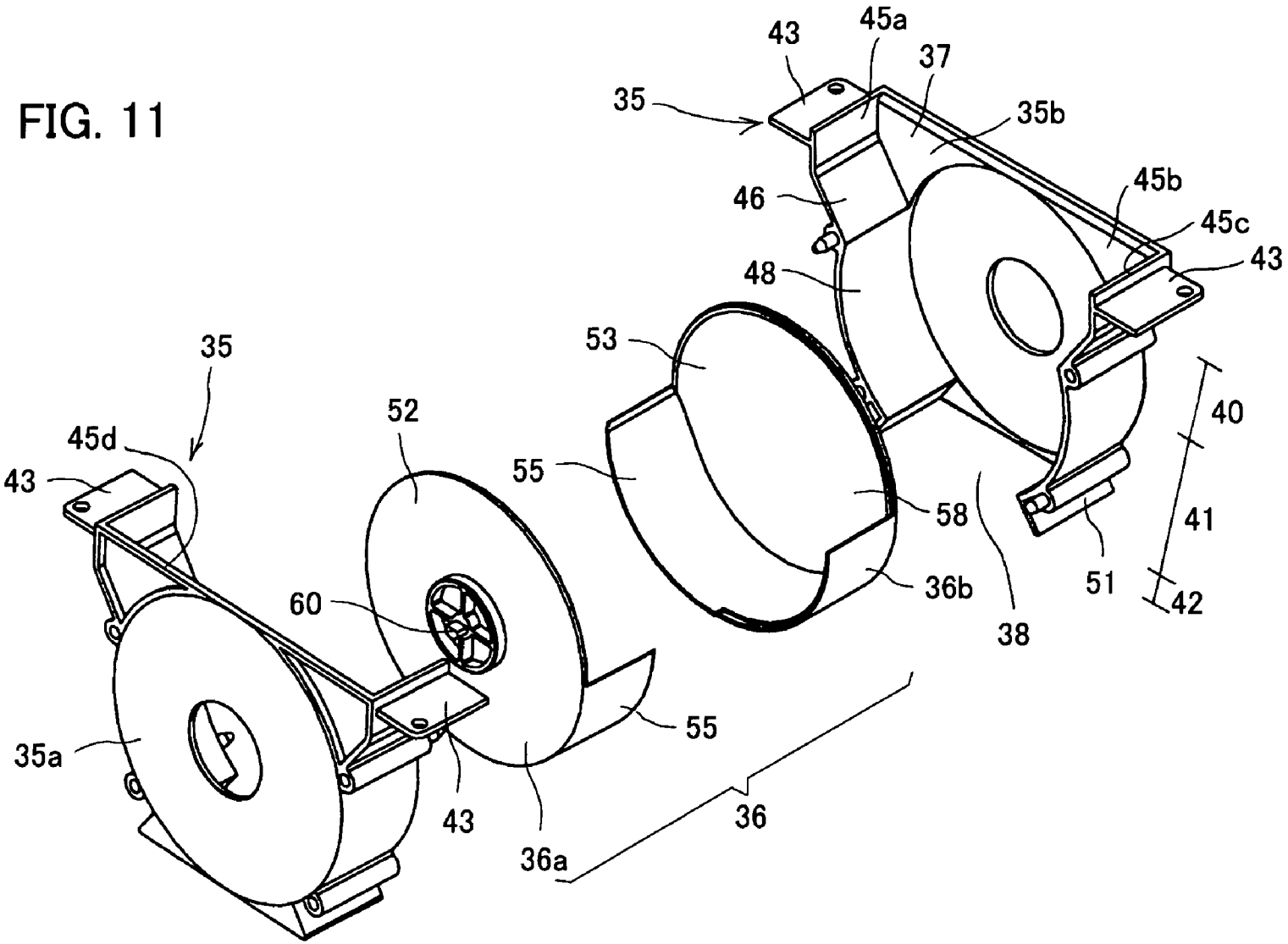
FIG. 11 is an exploded perspective view of the receptacle of the drug dispenser shown in FIG. 5.
Figure 12:
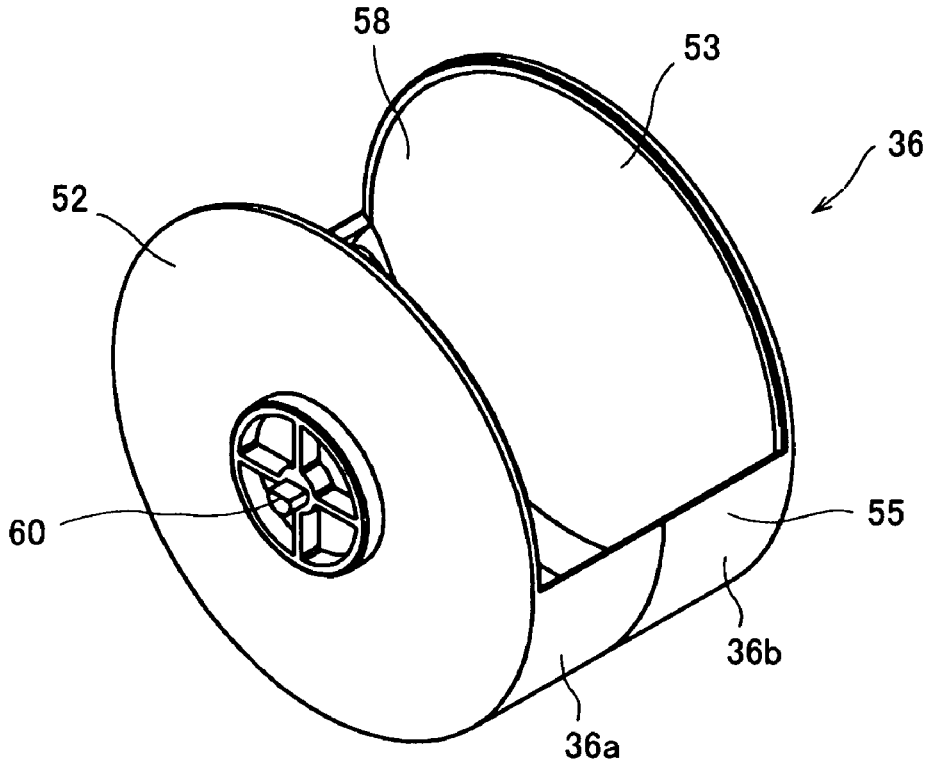
FIG. 12 is a perspective view of an inner receptacle portion of the drug dispenser shown in FIG. 5.

FIG. 5 is a perspective view of the drug dispenser 20 embodying the present invention as seen from its proximal end. FIG. 6 is a perspective view of the drug dispenser 20 as seen from its distal end. FIG. 7 is a plan view of the drug dispenser 20 shown in FIG. 5. FIG. 8 is a cross-sectional view as taken along A-A of FIG. 7. FIG. 9 is a perspective view of a receptacle 31 and a driving section 32 of the drug dispenser 20 of FIG. 5. FIG. 10 is a plan sectional view of a central part of the drug dispenser 20 of FIG. 5 with drugs bridged. FIG. 11 is an exploded perspective view of the receptacle 31 of the drug dispenser 20 shown in FIG. 5. FIG. 12 is a perspective view of an inner receptacle portion 36 of the drug dispenser 20 shown in FIG. 5.

Referring to FIGS. 5 and 6, the drug dispenser 20 characterizing the present invention having a casing 30, in which a receptacle 31 and a driving section 32 are integrally accommodated and united. In the casing 30, measures are adopted to readily install the drug dispenser 20 at a predetermined position.

The casing 30 is made of a thin steel plate. The drug dispenser 20 is covered with a cuboid casing 30. The drug dispenser 20 has an appearance as shown in FIGS. 5 and 6 and has a receptacle 31 opening at its top face. The drug dispenser 20 further has an engaging mechanism 92 and a handle 93 at its rear end (front side in FIG. 5). The engaging mechanism 92 is provided with a toggle-mechanism as described below. The handle 93 is a protruding portion of the bottom of the casing toward the rear end.

Referring to FIG. 6, a pressing member (or "pressing portion") 72 is protruded from the front end of the drug dispenser 20. A connector 94, as shown in FIG. 8, is exposed above the pressing member 72. Engaging pins (or "engaging portions") 75 are exposed at both sides adjacent to the front end of the drug dispenser 20. Functions of the pressing member 72, the engaging pins 75, and the connector 94 are described below.

The casing 30 accommodates the receptacle 31 and the driving section 32, which are extracted to be shown in FIG. 9.

Referring to FIG. 11, the receptacle 31 mainly consists of an outer receptacle portion 35 and an inner receptacle portion 36. The outer and inner receptacle portions 35 and 36 each are divided into two portions, which are united by a fitting or mating structure. More specifically, the outer receptacle portion 35 is an integrated combination of outer receptacle portion pieces 35*a* and 35*b*, whereas the inner receptacle portion 36 is an integrated combination of an inner receptacle portion pieces 36*a* and 36*b*.

The outer receptacle portion 35 is a receptacle having openings 37 and 38 (top opening 37 and bottom opening 38 respectively, if needed) at its top face and its bottom face as shown in FIG. 9 in fitting condition of the pieces 35*a* and 35*b*, which integrally constitute the outer receptacle portion 35 as described above. The outer receptacle portion 35 is substantially constant in width, but a large area side has a unique shape (hereinafter the large area side is referred to as a front side).

Specifically, the outer receptacle portion 35 roughly consists of an upper introducing section 40, an inner receptacle portion installing section 41, and a discharging section 42 in appearance.

The upper introducing section 40 has the large rectangle opening 37, at the both ends of the opening 37 flanges 43 being disposed. The four faces adjacent the opening 37 of the upper introducing section 40 are surrounded by vertical walls 45*a* to 45*d*.

The inner receptacle portion installing section 41 has a drum shape and looks like a circle from a front sight. The inner peripheral surface of the installing section 41 consists of arcuate surfaces 48.

The diameter of the arcuate surfaces 48 is equal to the height of the outer receptacle portion 35, as shown in FIG. 11. However, as the upper introducing section 40 is largely open as described above, the arcuate surfaces 48 do not form a perfect circle and have a part opened in the range about 120 degrees at their top.

The upper introducing section 40 and the inner receptacle portion installing section 41 described above are connected by inclined walls 46. Each of the inclined walls 46 has an angle of inclination enough to allow tablets or capsules to roll down without being halted; that is, in the range about 45 to 60 degrees. The present embodiment is designed on the assumption that tablets are accumulated below the inclined wall 46.

The outer receptacle portion 35 has an opening (a bottom opening) 38 at its bottom. A part below the opening 38 is expanded in diameter like a skirt so as to prevent tablets or capsules from sticking therein.

The inner receptacle portion 36, as shown in FIG. 12, has a shape of a drum and has a circular front wall 52, a circular rear wall 53, and a curved peripheral wall 55. In the present embodiment, as all walls of the inner receptacle portion 36 are rotatable, these walls are hereinafter referred to as a movable front wall 52, a movable rear wall 53, and a movable peripheral wall 55. The inner receptacle portion 36 is substantially the same in diameter and width with the inside of the above-mentioned inner receptacle portion installing section 41 of the outer receptacle portion 35.

The movable peripheral wall 55 of the inner receptacle portion 36 has an opening 58 formed at a part thereof. An angle opened at the movable peripheral wall 55 is larger than the angle opened at the top of the arcuate surface 48 of the outer receptacle portion 35 described above. Specifically, the angle opened at the movable peripheral wall 55 is larger in the range about 10 to 20 degrees than that at the arcuate surface 48 of the outer receptacle portion 35. However, a part except the opened part of the movable peripheral wall 55 has an effective length over 180 degrees.

The inner receptacle portion 36 is open only at the above-mentioned opening 58 of the movable peripheral wall 55, so the other part is closed. Thus, a part opposite to the opening 58 of the inner receptacle portion 36 is closed, so that the inner receptacle portion 36 has such a shape that things such as tablets are accumulated in its bottom.

The inner receptacle portion 36 is accommodated in the outer receptacle portion 35. More specifically, the inner receptacle portion 36 is positioned at the inner receptacle portion installing section 41 of the outer receptacle portion 35.

A plan sectional view in a condition of the inner receptacle portion 36 accommodated in the outer receptacle portion 35 is shown in FIG. 10. Specifically, as described above, the outer receptacle portion 35 is substantially constant in width W, and the inner receptacle portion 36 and the inner receptacle portion installing section 41 of the outer receptacle portion 35 each have a drum shape and a diameter D, which is longer than the width W. Thus, a central part of the inner receptacle portion 36 has a rectangular plane section with a longer side of the diameter D and a shorter side of the width W. The present embodiment has the movable front and rear walls 52 and 53 at the longer sides and the movable peripheral wall 55 at the shorter sides inside the outer receptacle portion 35.

As shown in FIG. 12, the inner receptacle portion 36 has a rotational shaft 60 at its center. As shown in FIG. 9, the rotational shaft 60 extends horizontally and penetrates the front side to be exposed outside and to be connected with a main gear 61. Thus, rotation of the main gear 61 exposed outside rotates the inner receptacle portion 36 placed inside around the horizontal rotational shaft 60; in other words, the movable front wall 52, the movable rear wall 53, and the movable peripheral wall 55 move.

Since the inner receptacle portion installing section 41 of the outer receptacle portion 35 is the arcuate surface 48, to which the curved surface of the movable peripheral wall 55 is in conformity, the movable peripheral wall 55 of the inner receptacle portion 36 slides on the arcuate surface 48 of the outer receptacle portion 35 in rotation of the inner receptacle portion 36.

In rotation of the inner receptacle portion 36, the movable front and rear walls 52 and 53 also slide on the inner surface of the outer receptacle portion 35.

The receptacle 31 has such a structure as described above, and further has the driving section 32 adjacent thereto.

Figure 13:
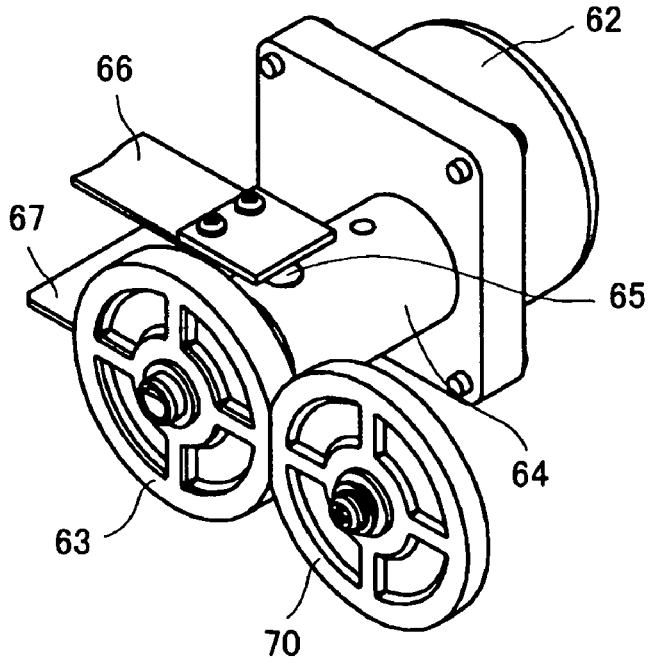
FIG. 13 is a perspective view of a main portion of the driving section.

FIG. 13 is a perspective view of a main portion of the driving section 32.

The driving section 32 is constituted by a geared motor 62 to which a driving gear 63 is attached. The number of teeth of the driving gear 63 is the same as that of the above-mentioned main gear 61.

In the present embodiment, the geared motor 62 and the driving gear 63 have a distance and a thick cylinder 64 therebetween. The thick cylinder 64 constitutes a rotation detecting section for detecting a rotational orientation of the inner receptacle portion 36 and, as shown in FIGS. 8 and 13, has a magnet 65 mounted on a part thereof. Tongue-like members 66 and 67 are further held with a distance over and below the top and bottom of the thick cylinder 64. Hall devices 68 and 69 are attached to the tongue-like members 66 and 67 respectively (FIG. 8).

As described above, the number of teeth of the driving gear 63 is the same as that of the main gear 61, the thick cylinder 64 integrally rotates with the driving gear 63, and the main gear 61 integrally rotates with the inner receptacle portion 36, so that the rotational orientation of the thick cylinder 64 corresponds to that of the inner receptacle portion 36. Further, in the present embodiment, the magnet 65 mounted on the thick cylinder 64 is placed at a position synchronized with the opening 58 of the inner receptacle portion 36. Therefore, when the Hall devices 68 and 69 detect an existence of the magnet 65, the inner receptacle portion 36 is open upward or downward.

The driving gear 63 of the driving section 32 is engaged with the main gear 61 of the inner receptacle portion 36 described above via an intermediate gear 70. In consequence, rotation of the motor 62 of the driving section 32 rotates the driving gear 63, whereby the main gear 61 is rotated via the intermediate gear 70, thereby rotating the inner receptacle portion 36 inside.

Figure 14:
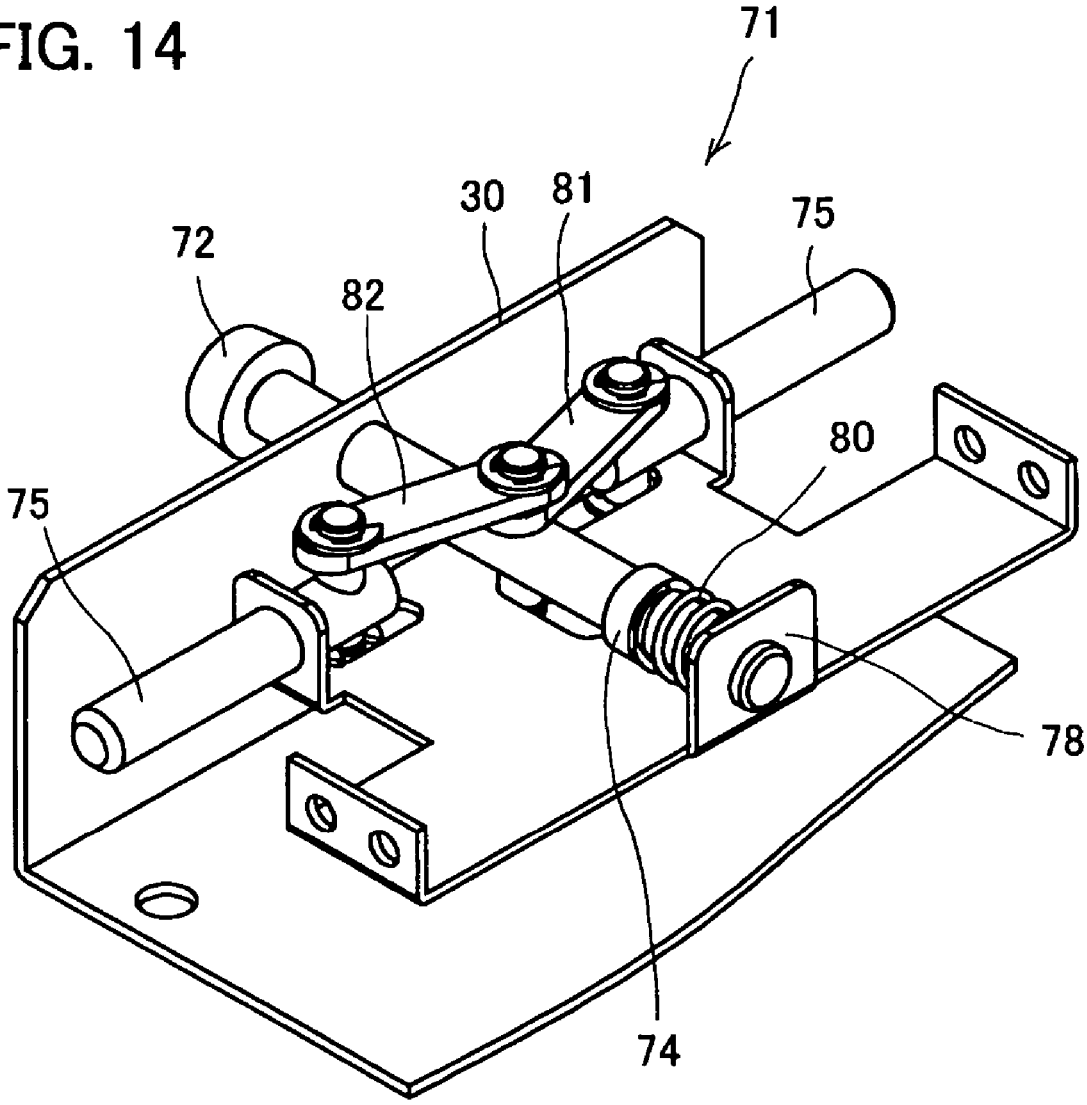
FIG. 14 is a perspective view of an engaging pin mechanical section.
Figure 15A:
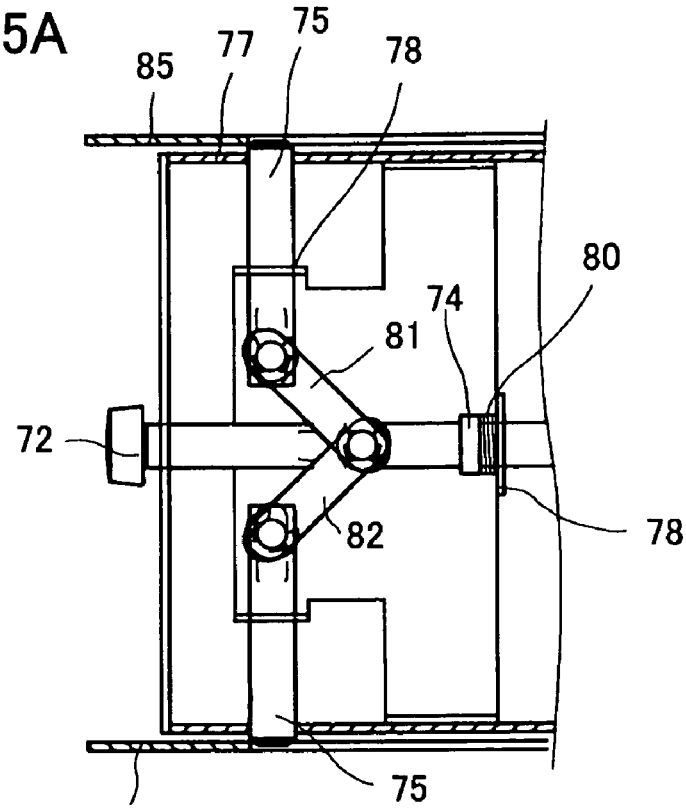
FIGS. 15A and 15B are plan views of the engaging pin mechanical section and a compartment therearound, FIG. 15A showing a state in which an engaging pin is retracted into a casing, FIG. 15B showing a state in which the engaging pin protrudes from the casing.
Figure 15B:
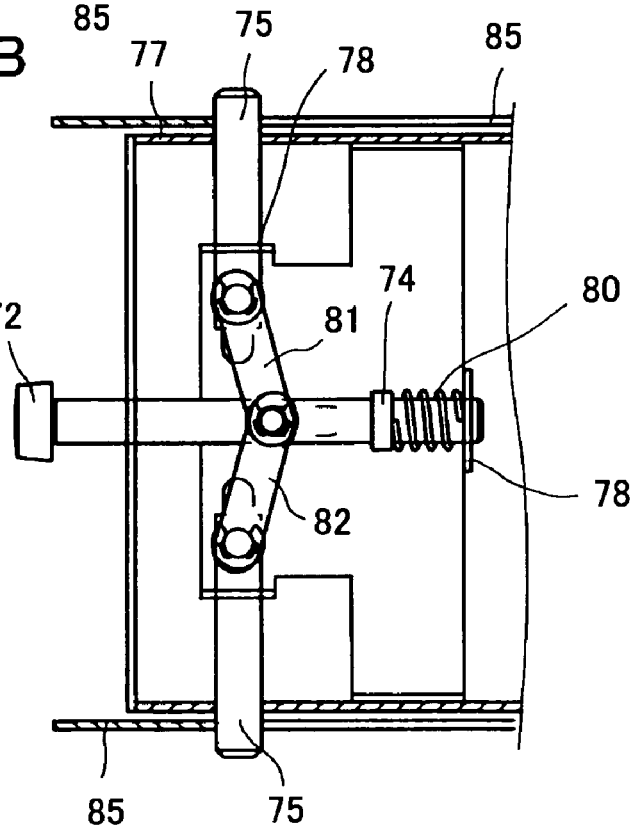

As for the detail of the drug dispenser 20, as shown in FIG. 7, an engaging pin mechanical section 71 is provided at a front end portion of the drug dispenser 20. FIG. 14 is a perspective view of the engaging pin mechanical section 71. FIGS. 15A and 15B are plan views of the engaging pin mechanical section 71 and a compartment 85 therearound, FIG. 15A showing a state in which the engaging pin 75 is retracted into the casing 30, FIG. 15B showing a state in which the engaging pin 75 protrudes from the casing 30.

The engaging pin mechanical section 71, as shown in FIG. 14, is constituted by the pressing member 72 and two engaging pins 75 connected with each other by a linkage.

Referring to FIG. 6, the pressing member 72 protrudes from the front end in a longitudinal direction of the drug dispenser 20, a main part of the member 72 being situated within the casing 30. The pressing member 72 is held in two places by means of a guiding member 78 provided at a part of and within the casing 30 and is guided so as to slide only in a longitudinal direction. The pressing member 72 has a spring support portion 74 with slightly larger diameter and formed adjacent to the rear end of the pressing member 72, and a spring 80 is attached between the guiding member 78 and the spring support portion 74. The pressing member 72 is normally urged in a protruding direction by means of the above-mentioned spring 72.

Two engaging pins 75 each are positioned in a direction perpendicular to the pressing member 72 with its distal end protruding from and retracted into the side of the casing. More specifically, as shown in FIG. 15, each of the engaging pins 75 is held in two places by a side wall 77 of the casing 30 and an inner guiding member 78 and is guided so as to slide only in a longitudinal direction.

The pressing member 72 and the engaging pins 75 are linked by two linking bars 81 and 82. Specifically, one linking bar 81 connects the pressing member 72 to one of the engaging pins 75, whereas the other linking bar 82 connects the pressing member 72 to the other engaging pin 75. Both ends of the linking bars 81 and 82 each are rotatively connected by pins.

Thus, when the pressing member 72 is pressed in, the proximal ends of the linking bars 81 and 82 are moved backward so as to draw the distal ends of the bars 81 and 82 inward. As described above, as the engaging pins 75 each are held in two places at the side wall 77 of the casing 30 and the inner guiding member 78 and guided so as to slide only in a longitudinal direction, the engaging pins 75 are drawn by the linking bars 81 and 82 to be retracted into the casing 30.

Further, the casing 30 has the connector 94 protruding from its distal end. The connector 94 is a male-connector, or a casing connector for supplying electricity to the motor 62 accommodated in the casing 30.

Still further, the casing 30 has the toggle-type engaging mechanism 92 mounted on its proximal end as shown in FIG. 5. The engaging mechanism 92 has a lever 97 and a hook 98. When the distal end of the lever 97 is upheld, the hook 98 moves upward, and when the distal end of the lever 97 is turned downward as shown in FIG. 5, the hook 98 moves downward. At this time, doubled force pushes the hook 98 downward by the principle of the known toggle-mechanism, so that the hook 98 does not move upward unless the lever 97 is operated.

In the drug filling apparatus 1 in the present embodiment, as shown in FIG. 3, a portion in which the drug dispenser 20 is installed is divided from an adjacent portion by a compartment 85.

Figure 16:
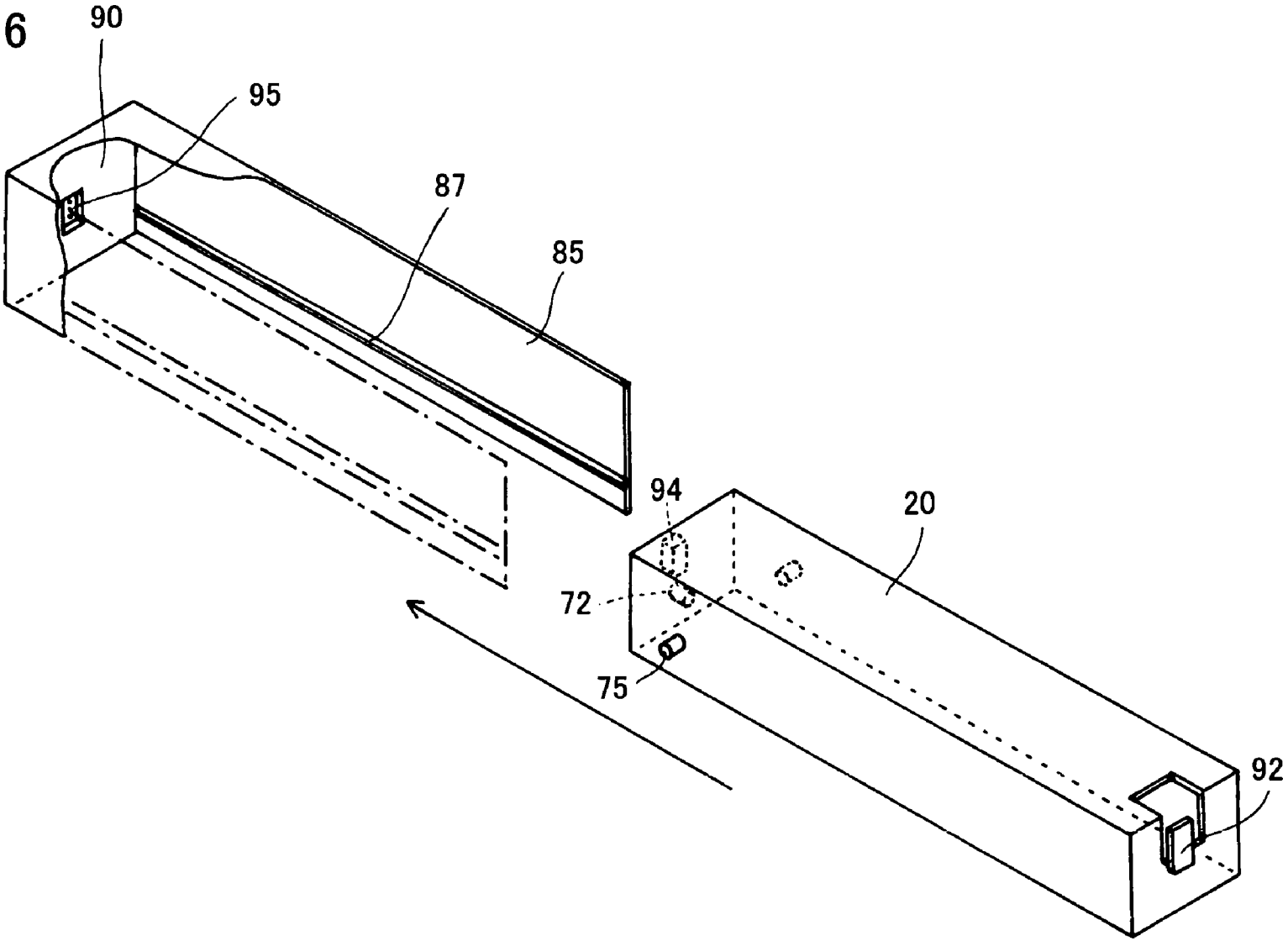
FIG. 16 is a perspective view showing a procedure for installing the drug dispenser.

The compartment 85, detailed in FIG. 2, is divided off at the substantially same width with that of the drug dispenser 20. The compartment 85 has elongated holes 86 and 87 extending in a longitudinal direction respectively on its both walls. Herein, the compartment 85 shown in FIG. 2 for the drug dispensers 20 to be arranged at both sides of the vertical wall 16 is constituted by one channel member and has a wall 90 as shown in FIG. 16 at a central part therein. A connector 95 protrudes at the wall 90. The connector 95 is a female-connector, or a main body connector for supplying electricity to the motor 62 accommodated in the casing 30. The connector 95 is positioned where the connector 94 of the drug dispenser 20 comes in contact when the drug dispenser 20 is installed in the compartment 85.

In the drug filling apparatus 1 of the present embodiment, the drug dispenser 20 is installed according to the following procedure. FIG. 16 is a perspective view showing the procedure for installing the drug dispenser 20. Specifically, before installing the drug dispenser 20, the pressing member 72 at its distal end is to be pressed into the casing 30. That moves the proximal ends of the linking bars 81 and 82 backward, thereby drawing the distal ends of the bars 81 and 82, with the result that the engaging pins 75 are retracted into the casing 30.

The drug dispenser 20 is introduced into the compartment 85 shown in FIGS. 2 and 16 with the engaging pins 75 retracted into the casing 30 pushing the pressing member 72 in this way, whereupon the pressure by the pressing member 72 is released. As a consequence, the engaging pins 75 protrudes relative to the compartment 85 to enter into the elongated holes 86 and 87 as shown in FIG. 15. Specifically, the engaging pins 75 engage with the elongated holes 86 and 87, and whereby the distal end of the drug dispenser 20 is movable in a longitudinal direction but is not separable from the compartment 85.

From this state, the drug dispenser 20 is forced forward along the compartment 85. As described above, as the engaging pins 75 engage with the elongated holes 86 and 87 and the distal end of the drug dispenser 20 is movable in a longitudinal direction but stays within the compartment 85, workers only push the proximal end of the drug dispenser 20 to move the drug dispenser 20 forward along to the elongated holes 86 and 87.

When the distal end of the drug dispenser 20 reaches the wall 90, further pushing of the drug dispenser 20 makes the connector 94 protruding from the distal end of the drug dispenser 20 to engage with the connector 95. In short, the drug dispenser 20 is electrically connected with the main body by pushing the drug dispenser 20 into the compartment 85.

After completion of connection of the connectors 94 and 95, the engaging mechanism 92 at the rear end is operated to engage the hook 98 to a part of the main body. In this way, the drug dispenser 20 is installed in the main body of the drug filling apparatus 1. Specifically, the drug dispenser 20 is made a lateral positioning by the compartments 85 and an antero-posterior positioning by the wall 90. Further, a vertical positioning is made by the engagement of the engaging pins 75 to the elongated holes 86 and 87 and the engagement of the hook 98 to the part of the main body.

Figure 17:
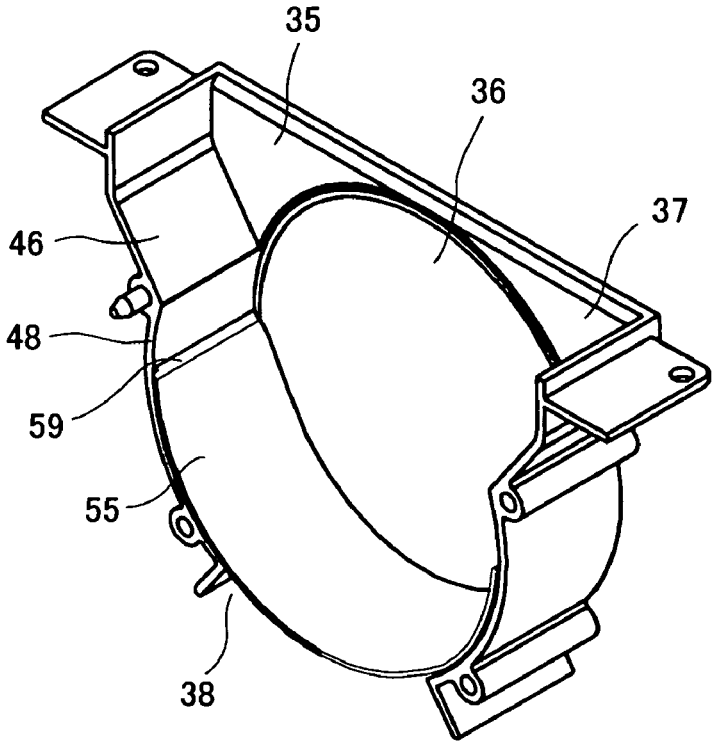
FIG. 17 is a partially sectional perspective view showing a positional relationship between an outer receptacle portion and the inner receptacle portion of the drug dispenser in the embodiment in a holding state.
Figure 18:
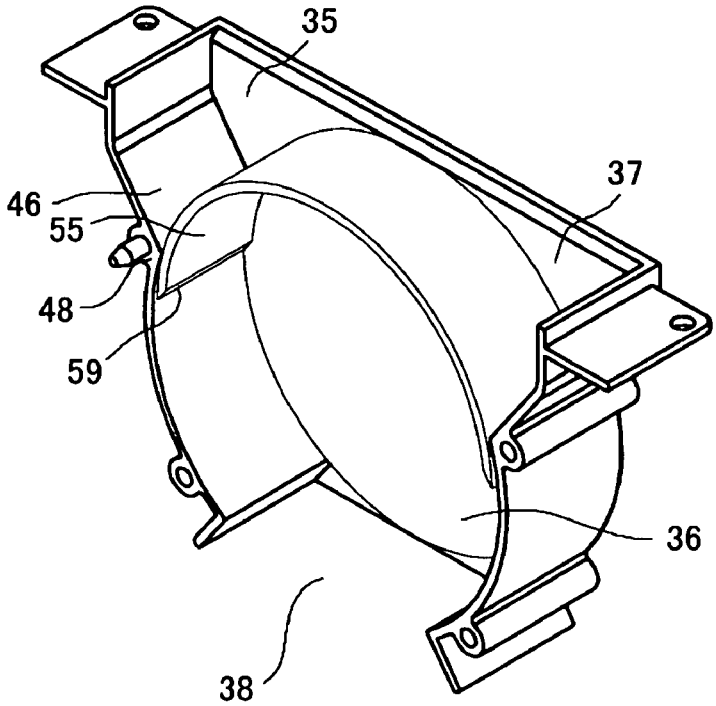
FIG. 18 is a partially sectional perspective view of a positional relationship between the outer receptacle portion and the inner receptacle portion of the drug dispenser in the embodiment in discharging drugs.

Now, a function of the drug dispenser of the present embodiment will be described below. FIG. 17 is a partially sectional perspective view showing a positional relationship between the outer receptacle portion 35 and the inner receptacle portion 36 of the drug dispenser 20 in the embodiment in a holding state. FIG. 18 is a partially sectional perspective view of a positional relationship between the outer receptacle portion 35 and the inner receptacle portion 36 of the drug dispenser 20 in the embodiment in discharging drugs. FIGS. 19A to 19D are cross-sectional views sequentially showing a series of operations of the drug dispenser 20 in the embodiment.

Referring to FIGS. 5 and 17, the drug dispenser 20 in the present embodiment waits ready with the opening 58 of the inner receptacle portion 36 upward.

In the state with the opening 58 of the inner receptacle portion 36 upward in this way, the opening 58 faces toward the top opening 37 of the outer receptacle portion 35 and the bottom opening 38 of the outer receptacle portion 35 is closed by an arcuate wall of the inner receptacle portion 36.

Therefore, when some of the drug feeders 12 over the drug dispenser 20 operate to drop tablets from the common passageway 18, some tablets get inside from the top opening 37 of the outer receptacle portion 35 and further get directly inside the inner receptacle portion 36. Some tablets get inside the receptacle 31, then once come into contact with the inclined wall 46 of the outer receptacle portion 35, and fall down the inclined wall 46 to get inside the inner receptacle portion 36. Herein, as described above, the angle of inclination of the inclined wall 46 is a steep angle in the range of about 45 to 60 degrees, thereby preventing the tablets from being caught.

Further, as described above, as the angle opened at the movable peripheral wall 55 of the inner receptacle portion 36 is larger in the range of 10 to 20 degrees than that at the arcuate surface 48 of the outer receptacle portion 35, opening ends 90 of the inner receptacle portion 36 are hidden behind the arcuate surface 48. Still further, as the movable peripheral wall 55 has an effective length over 180 degrees, the opening ends 59 each face downward. Thus, in a holding state, tablets are never caught at the opening ends 59 of the inner receptacle portion 36. Consequently, tablets sent out from the drug feeders 12 get into the inner receptacle portion 36 without being caught.

Then, in order to fill the tablets in the drug dispenser 20 into a vial, the motor 62 of the driving section 32 rotates in response to a predetermined signal to rotate the inner receptacle portion 36. Specifically, the inner receptacle portion 36 is reversed so as to change the rotational orientation of the inner receptacle portion 36.

More specifically, the opening 58 of the movable peripheral wall 55 of the inner receptacle portion 36 facing upward in holding is made to turn downward by being reversed. Herein, as described above, as the rotational orientation of the thick cylinder 64 of the rotation detecting section corresponds to that of the inner receptacle portion 36, in actuality, the motor 62 is made stopped when the inner receptacle portion 36 has been reversed by rotation of the motor 62, with monitoring the position of the magnet 65 disposed at the thick cylinder 64 by the Hall devices 68 and 69.

In doing so, the opening 58 of the inner receptacle portion 36 corresponds to the bottom opening 38 of the outer receptacle portion 35, so that the inner receptacle portion 36 is open outward, whereupon the tablets accumulated inside fall down at once to be received in the moving hopper 25 of the conveyor 21 or 22 expecting them.

In the present embodiment, as the inner surface of the inner receptacle portion installing section 41 of the outer receptacle portion 35 corresponds to the movable peripheral wall 55 of the inner receptacle portion 36, the movable peripheral wall 55 slides on the arcuate surface 48 of the outer receptacle portion 35 in rotation of the inner receptacle portion 36, with the result that no gap substantially exists between the both, allowing no worry about that the tablets might be fitted into the gap. As the movable front and rear walls 52 and 53 of the inner receptacle portion 36 slide on the inner surface of the outer receptacle portion 35, as well as the movable peripheral wall 55, no gap substantially exists between the inner surface and the walls 52 and 53, allowing no worry about that the tablets might be fitted into the gap.

Herein, in the present embodiment, when the motor 62 of the driving section 32 rotates to rotate the inner receptacle portion 36 as described above, the inner receptacle portion 36 is made one and a half rotations so as to turn the opening 58 of the inner receptacle portion 36 downward.

Figure 19A:
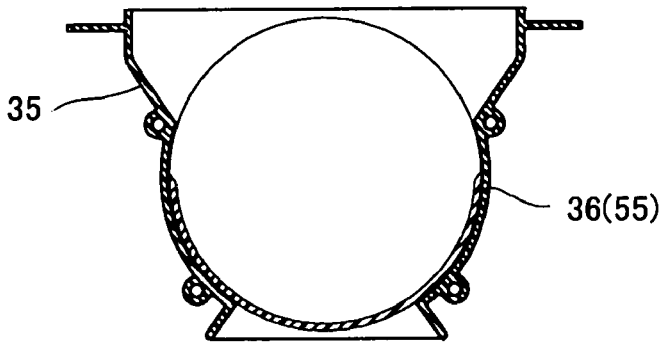
FIGS. 19A to 19D are cross-sectional views sequentially showing a series of operations of the drug dispenser in the embodiment.
Figure 19B:
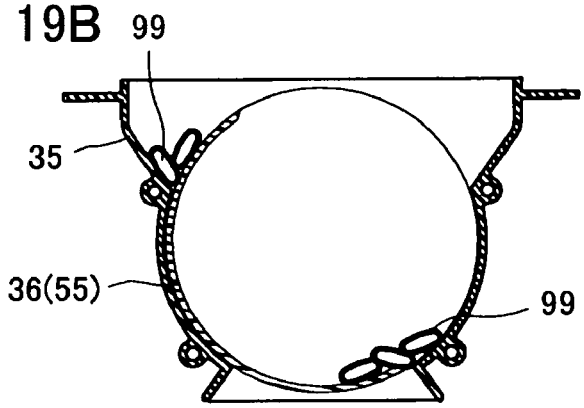

That is due to the following reasons:

When the inner receptacle portion 36 waiting ready in a position shown in FIG. 19A is made to rotate as shown in FIG. 19B, in the case that tablets 99 are filled to overflowing from the inner receptacle portion 36, the tablets 99 may remain between the outside of the peripheral wall 55 and the inclined wall 46 resulting from the opening end of the peripheral wall 55 cutting into the tablets 99 as shown in FIG. 19B.

Figure 19C:
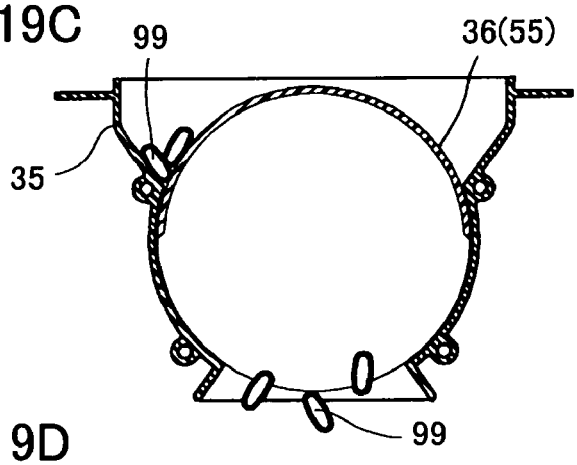

More specifically, as shown in FIG. 19C, the tablets 99 entirely contained within the inner receptacle portion 36 fall down from the bottom opening 38 by reversing the inner receptacle portion 36, but the tablets out of the inner receptacle portion 36 remain between the outside of the peripheral wall 55 and the inclined wall 46.

Figure 19D:
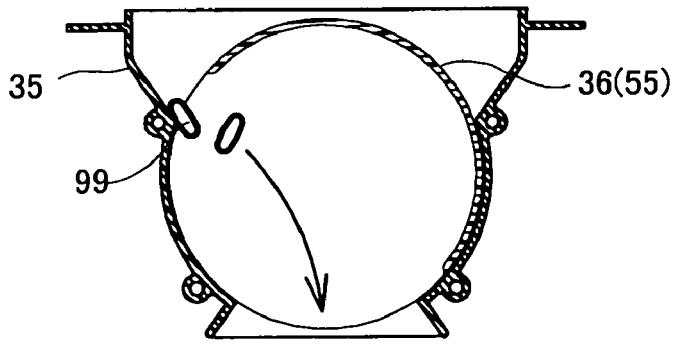

Thus, in order to solve the problem described above, the present embodiment makes one and a half rotations of the inner receptacle portion 36. As shown in FIG. 19D, the tablets 99 remained after the first rotation enter the inner receptacle portion 36, whereupon the tablets 99 newly entered fall down when the opening of the inner receptacle portion 36 turns downward by a next half rotation of the inner receptacle portion 36.

Even if the tablets 99 in the inner receptacle portion 36 form a bridge, reversal of the inner receptacle portion 36 changes the direction of pressure between the tablets 99, thereby breaking the bridge. Since the tablets 99 in the bottom of the inner receptacle portion 36 at the positive position of the inner receptacle portion 36 are positioned over the bridge in reversing of the inner receptacle portion 36, weight of the tablets 99 in the bottom breaks the bridge. Further, in the embodiment, a pair of walls opposing in a width direction that come into contact with the bridge; more specifically, the circular movable front and rear walls 52 and 53 rotationally move, so that the ends of the bridge are separated to break the bridge.

Figure 20A:
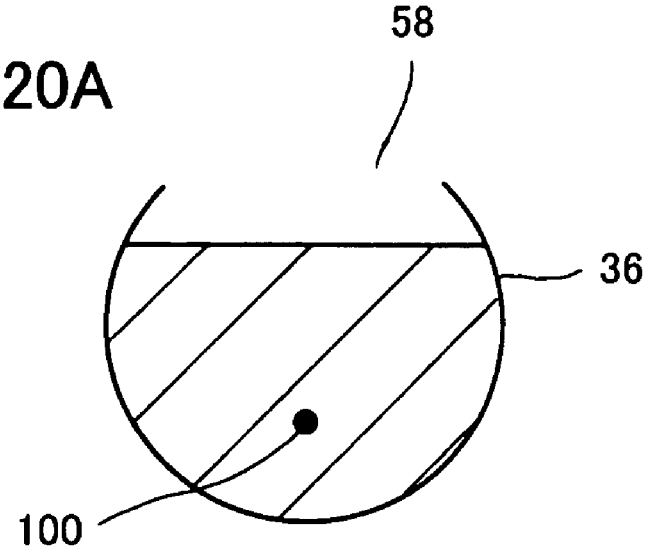
FIGS. 20A to 20C are schematic diagrams showing a relationship among conveyance of drugs, movements of a movable front wall and a movable rear wall, and a bridge, FIG. 20A showing a state immediately after charging of drugs via the common passageway, FIG. 20B showing a state immediately after rotation of the inner receptacle portion, FIG. 20C showing a state in half rotation of the inner receptacle portion.
Figure 20B:
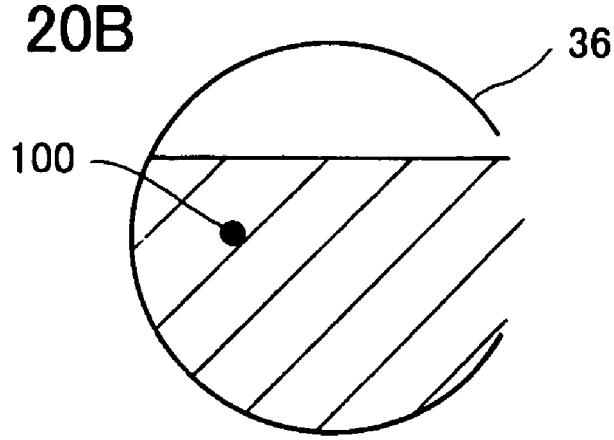
Figure 20C:
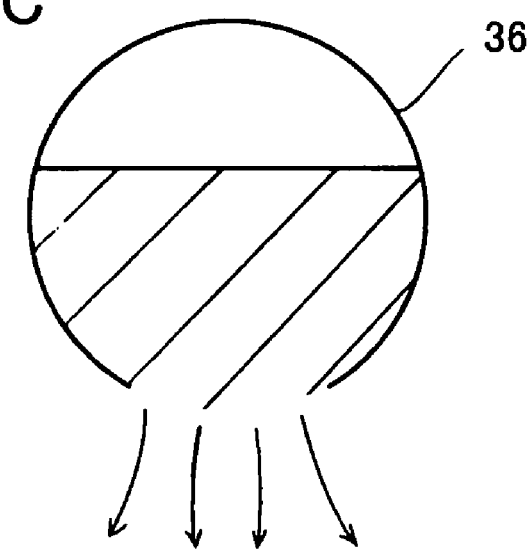

This mechanism is described in detail below. FIGS. 20A to 20C are schematic diagrams showing a relationship among conveyance of drugs, movements of the movable front and rear walls 52 and 53, and a bridge, FIG. 20A showing a state immediately after charging of tablets via the common passageway 18, FIG. 20B showing a state immediately after rotation of the inner receptacle portion 36, FIG. 20C showing a state in half rotation of the inner receptacle portion 36.

As shown in FIG. 10, the tablets 99 form a bridge such as crossing a width of the receptacle 31. As described above, the receptacle 31 has the longer sides of the diameter D and the shorter sides of the diameter W in a plan view. The bridge of the tablets 99 crosses between the longer sides; more specifically, between the movable front wall 52 and the movable rear wall 53 as shown in FIG. 10.

FIGS. 20A to 20C show front views of these states.

Referring to FIG. 20A, a bridge 100 is formed slightly below the level of central part. Tablets are accumulated in a hatching area. As the present embodiment, as described above, is designed on the assumption that tablets are accumulated in part below the inclined walls 46, the tablets exist within an area sandwiched by the movable front and rear walls 52 and 53. Conversely, in the present embodiment, the movable front wall 52 is positioned where drugs are expected to be accumulated.

Upon rotation of the inner receptacle portion 36, as shown in FIG. 20B, the ends of the bridge 100 are moved in the upper left direction in the drawing. More specifically, as the bridge 100 is formed between the movable front and rear walls 52 and 53, the ends of the bridge 100 are forced to move with the walls 52 and 53 moved by their rotation. But, as shown in FIG. 20B, the tablets in the hatching area except the constituent pieces of the bridge 100 fall down the movable peripheral wall 55 to keep their initial positions even with rotation of the inner receptacle portion 36. Thus, an unsettled middle portion of the bridge departs from the ends so that the bridge is broken.

Consequently, tablets entered the drug dispenser 20 in the present embodiment are all discharged to the next process with no piece caught.

Figure 21:
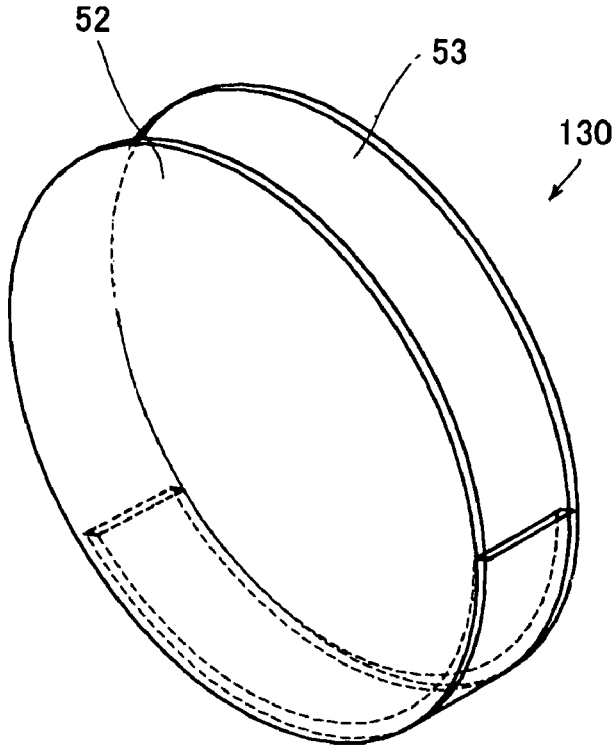
FIG. 21 is a perspective view of an inner receptacle portion employed in a drug dispenser in another embodiment of the invention.
Figure 22:
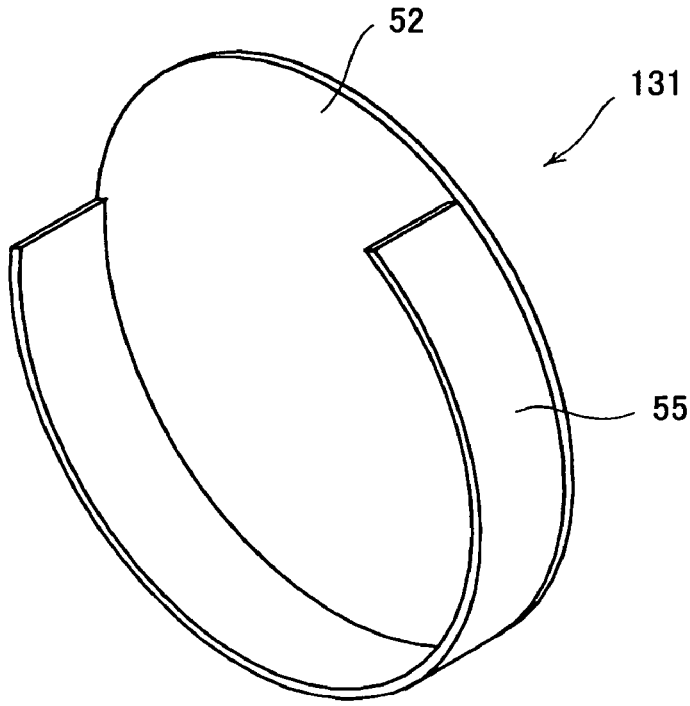
FIG. 22 is a perspective view of an inner receptacle portion employed in a drug dispenser in still another embodiment of the invention.
Figure 23:
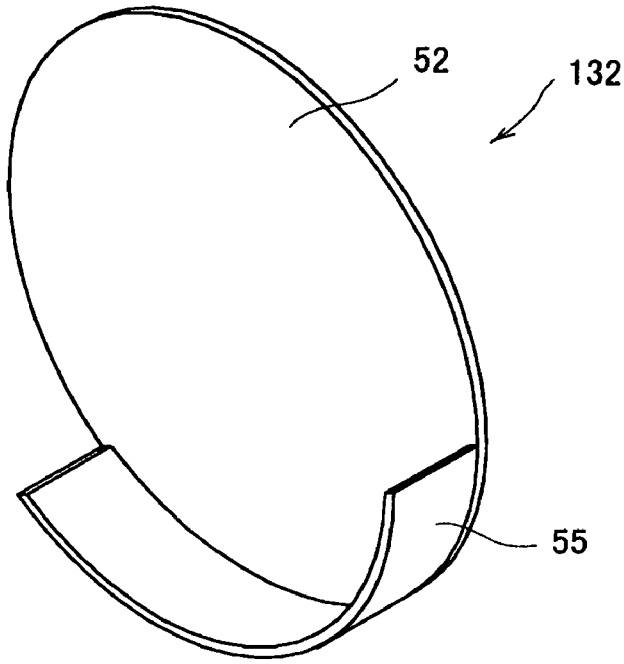
FIG. 23 is a perspective view of an inner receptacle portion employed in a drug dispenser in yet another embodiment of the invention.

Now, a modified embodiment of the present invention will be described below. FIGS. 21, 22, and 23 are perspective views of inner receptacle portions employed in drug dispensers in other embodiments of the present invention.

The above-mentioned embodiment takes for instance the inner receptacle portion 36 including the circular movable front and rear walls 52 and 53 and the curved movable peripheral wall 55 of over 180 degrees in length. However, the present invention is not limited thereto, and for example, can have an inner receptacle portion 130 shown in FIG. 21 including the movable peripheral wall 55 of less than 180 degrees in length. Further, the present invention can have an inner receptacle portion 131 shown in FIG. 22 without either the movable front wall 52 or the movable rear wall 53. Still further, the present invention can have an inner receptacle portion 132 shown in FIG. 23 including the movable peripheral wall 55 of less than 180 degrees in length and without either the movable front wall 52 or the movable rear wall 53.

In the embodiments just described, the inner receptacle portion 36 has together a function of a receptacle for temporarily accumulating tablets and a function of a closing member for closing the bottom opening of the outer receptacle portion 35. The above-mentioned embodiments reverse the inner receptacle portion 36 within the outer receptacle portion 35 intending to change a direction of pressure between tablets or break a bridge by weight of drugs located at the bottom of the inner receptacle portion 36. However, as another measure to avoid a bridge, operations of a closing member can scrape part of the bridge to break the bridge.

Figure 24:
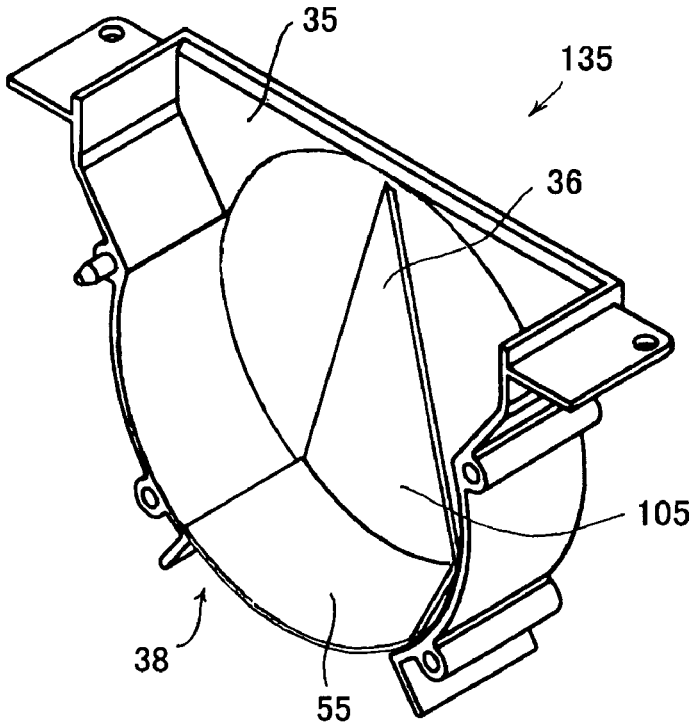
FIG. 24 is a partially sectional perspective view of a positional relationship between an outer receptacle portion and the inner receptacle portion of the drug dispenser in yet another embodiment of the invention in a holding state.
Figure 25:
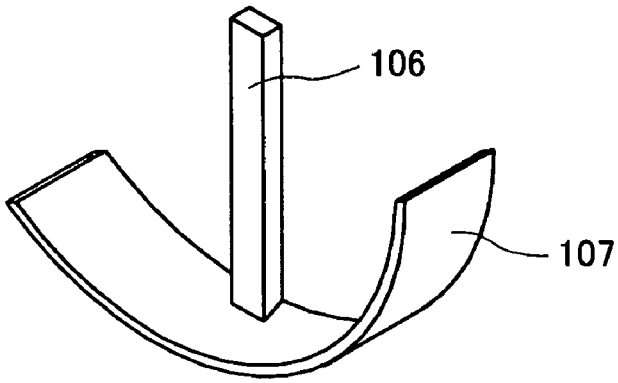
FIG. 25 is a perspective view of an inner receptacle portion employed in a drug dispenser in yet still another embodiment of the invention.

An inner receptacle portion 135 shown in FIG. 24 has a main function to scrape part of a bridge. FIG. 24 is a partially sectional perspective view showing the outer receptacle portion 35 and the inner receptacle portion 36 in still another embodiment of the invention in a holding state. FIG. 25 is a perspective view of the inner receptacle portion 36 employed in a drug dispenser in still another embodiment of the invention.

In a receptacle shown in FIG. 24, the inner receptacle portion 36 has a short peripheral wall, only functioning as a closing member for closing the bottom opening 38 of the outer receptacle portion 35. Front and rear walls each have a narrow arm shape. The arm-shaped portion 105 functions as a scraper 105.

In a drug dispenser in the present embodiment, upon rotation of the inner receptacle portion 36, the scrapers 105 (the arm-shaped front and rear walls) scrape the inner surface of the receptacle. Therefore, upon rotation of the inner receptacle portion 36, the scrapers 105 scrape part of a bridge of tablets to break the bridge. The arcuate peripheral wall 55 draws a large rotational trajectory, thereby cutting into a bridge. That breaks the bridge, so that tablets entered the drug dispenser are all discharged to the next process without any piece caught.

It is also possible, as shown in FIG. 25, that a mere connecting member 106 instead of a wall such as the front wall operates a closing member 107. In the embodiment shown in FIG. 25, the connecting member 106 functions as the scraper 105.

Figure 26:
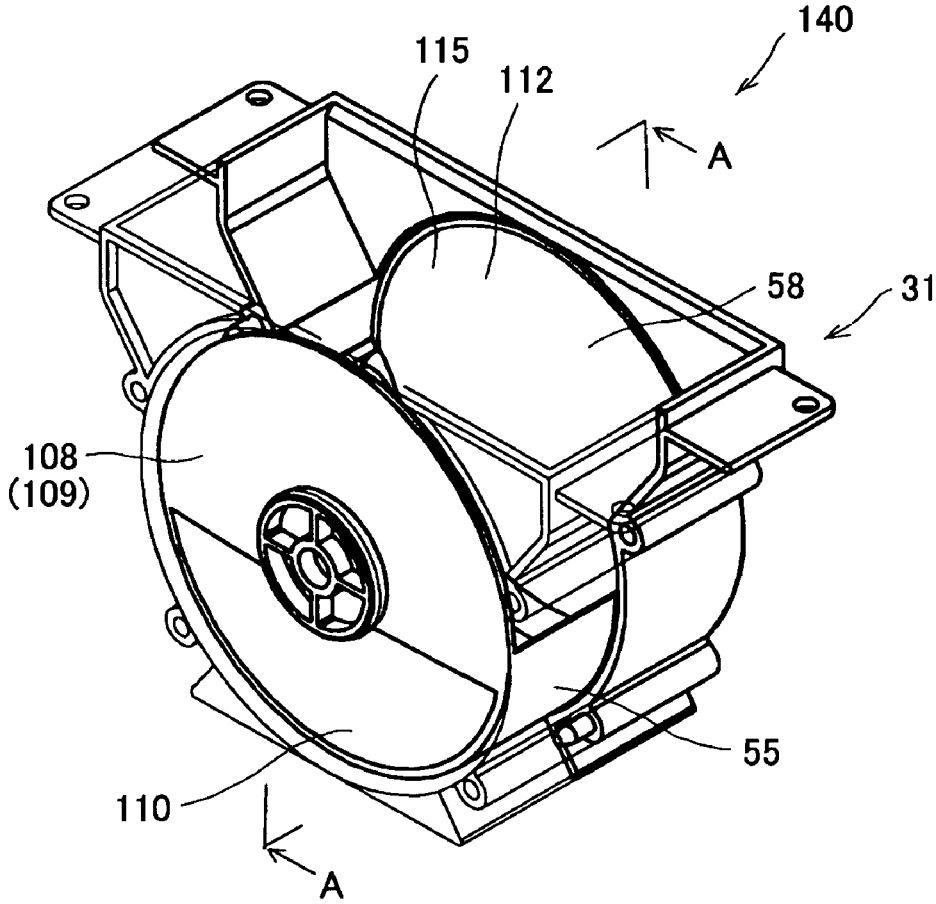
FIG. 26 is a sectional perspective view of a receptacle employed in a drug dispenser in a further embodiment of the invention.
Figure 27:
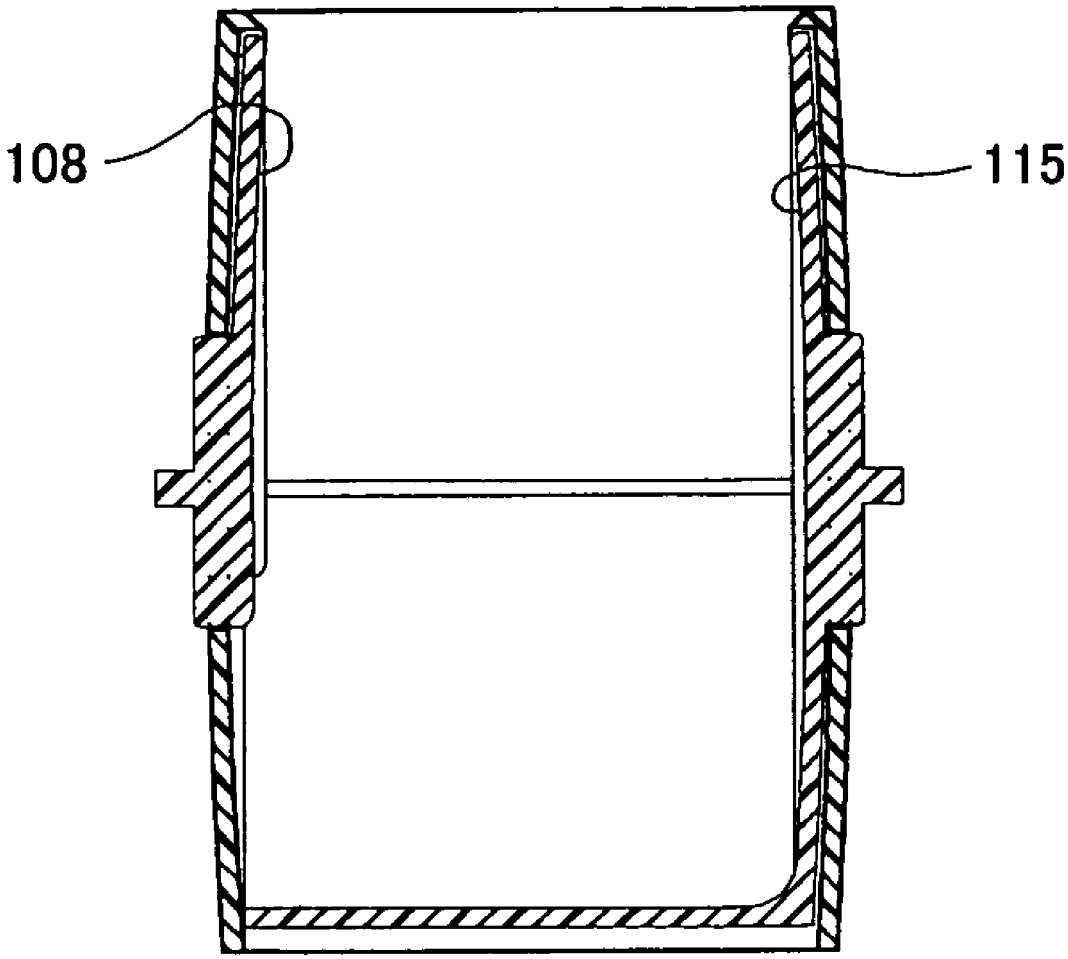
FIG. 27 is a cross-sectional view as taken along A-A of FIG. 26.

Further, as shown in FIG. 26, a movable front wall 108 with an opening 110 can be expected to have the same effect. FIG. 26 is a sectional perspective view of a receptacle employed in a drug dispenser in a further embodiment of the invention. FIG. 27 is a cross-sectional view as taken along A-A of FIG. 26.

A drug dispenser 140 shown in FIG. 26 includes a movable front wall 108 having a circular outer frame and having a semi-circular opening 110 at an area of 180 degrees adjacent to a movable peripheral wall 55. Thus, only a frame portion remains at the movable front wall 108 corresponding to the end of the movable peripheral wall 55 and most part is open. In the present embodiment, the opening 110 is formed only at the movable front wall 108 and not at a movable rear wall 115, but can be formed at the movable rear wall 115.

In this embodiment, a remaining portion 109 of the movable peripheral wall 108; that is, a semi-circular portion adjacent to the opening 58 functions as a scraper 109.

In this embodiment, when a receptacle 112 as a closing member opens the bottom opening of the receptacle 31, the scraper 109 scrapes the inner surface of the receptacle 31. Thereby, upon rotation of the inner receptacle portion 36, the scraper 109 scrapes part of a bridge of tablets to break the bridge.

Each of the embodiments described above has such a structure that the scraper 109 scrapes the inner surface of the receptacle 31, but can have such a structure that the scraper 109 is slightly let off the inner surface of the receptacle 31 to cross a vicinity of the inner surface of the receptacle.

Figure 32A:
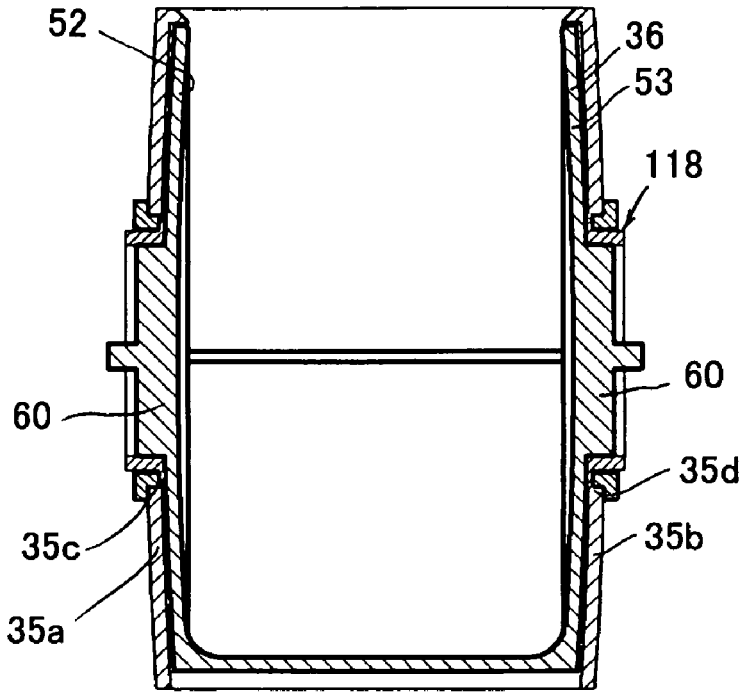
FIG. 32 is a cross-sectional view of a modified receptacle employed in the drug dispenser in the present invention.
Figure 32B:
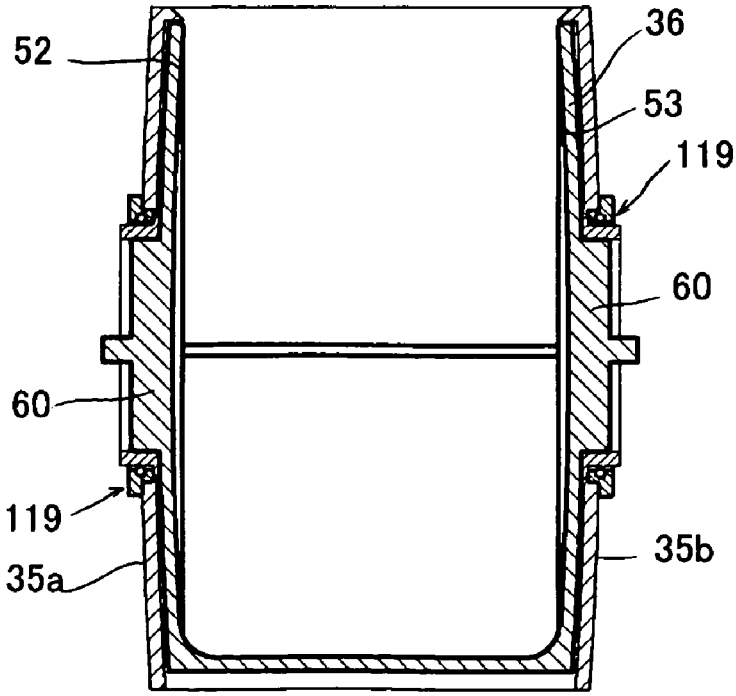

The above-mentioned embodiment, as shown in FIG. 11, has such a structure that the rotational shafts 60 protruding from the movable front and rear walls 52 and 53 of the inner receptacle portion 36 are introduced into openings 35*c* and 35*d* formed at the outer receptacle portion pieces 35*a* and 35*b*, but, as shown in FIG. 32, can have such a structure that sliding bearings 118 or turning bearings 119 with bushings made of a material such as resin including an ABS resin, carbon graphite, or stainless steel are interposed between the rotational shafts 60 and the openings 35*c* and 35*d*. In this structure, the inner receptacle portion 36 smoothly rotates within the outer receptacle portion 35.

In every embodiment described above, the inner receptacle portion (closing member) rotates to open and close the bottom opening of the receptacle, but the present invention can be employed in a structure having a sliding closing member.

Now, an aspect of the present invention employed in a shutter structure in which a closing member slides will be described below. Hereinafter, redundant descriptions on the similar members as used in the foregoing embodiments are omitted for simplicity, numbering the same reference numerals.

Figure 28:
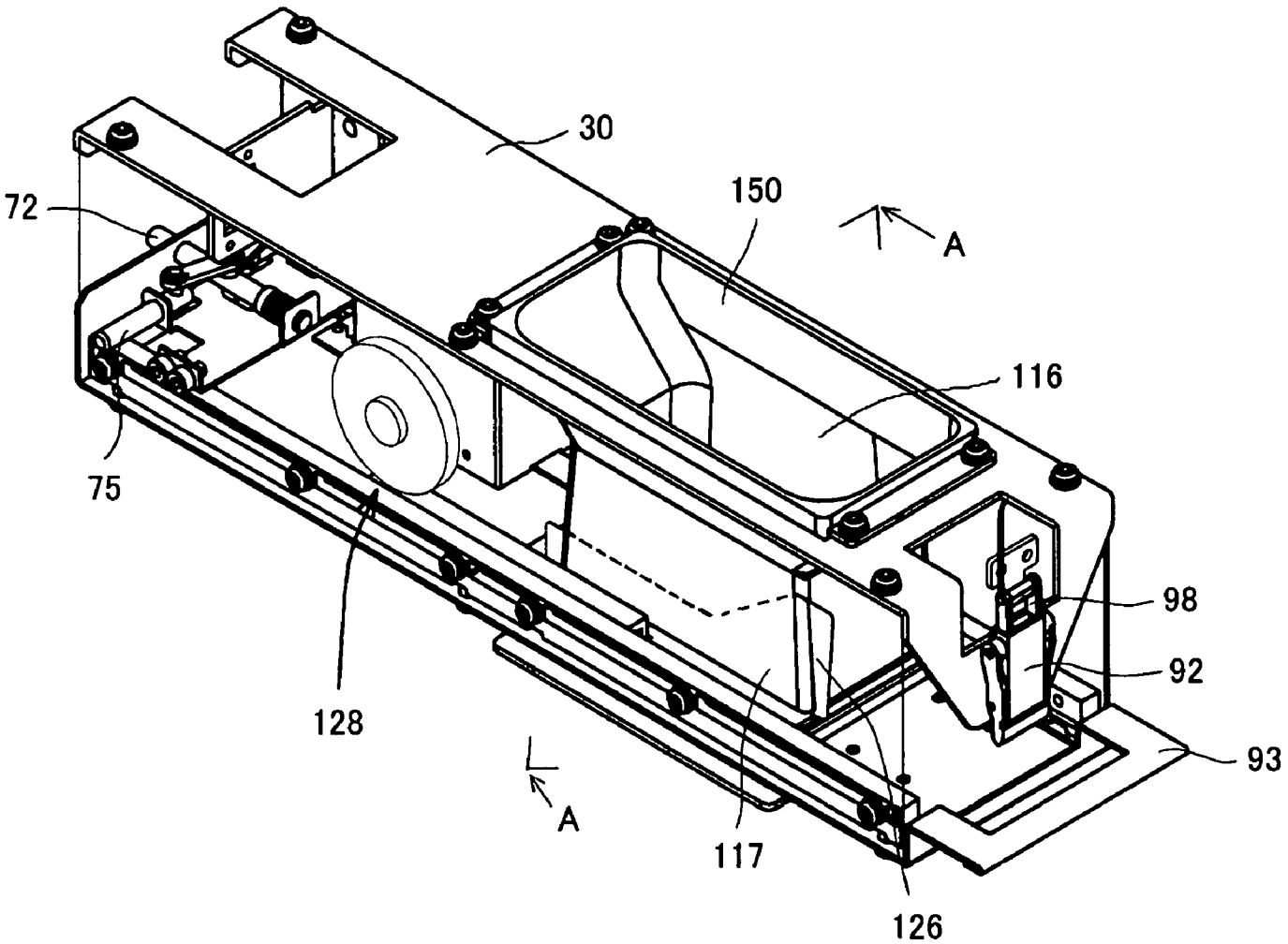
FIG. 28 is a perspective view of a drug dispenser in another embodiment of the invention as seen from its proximal end.
Figure 29:
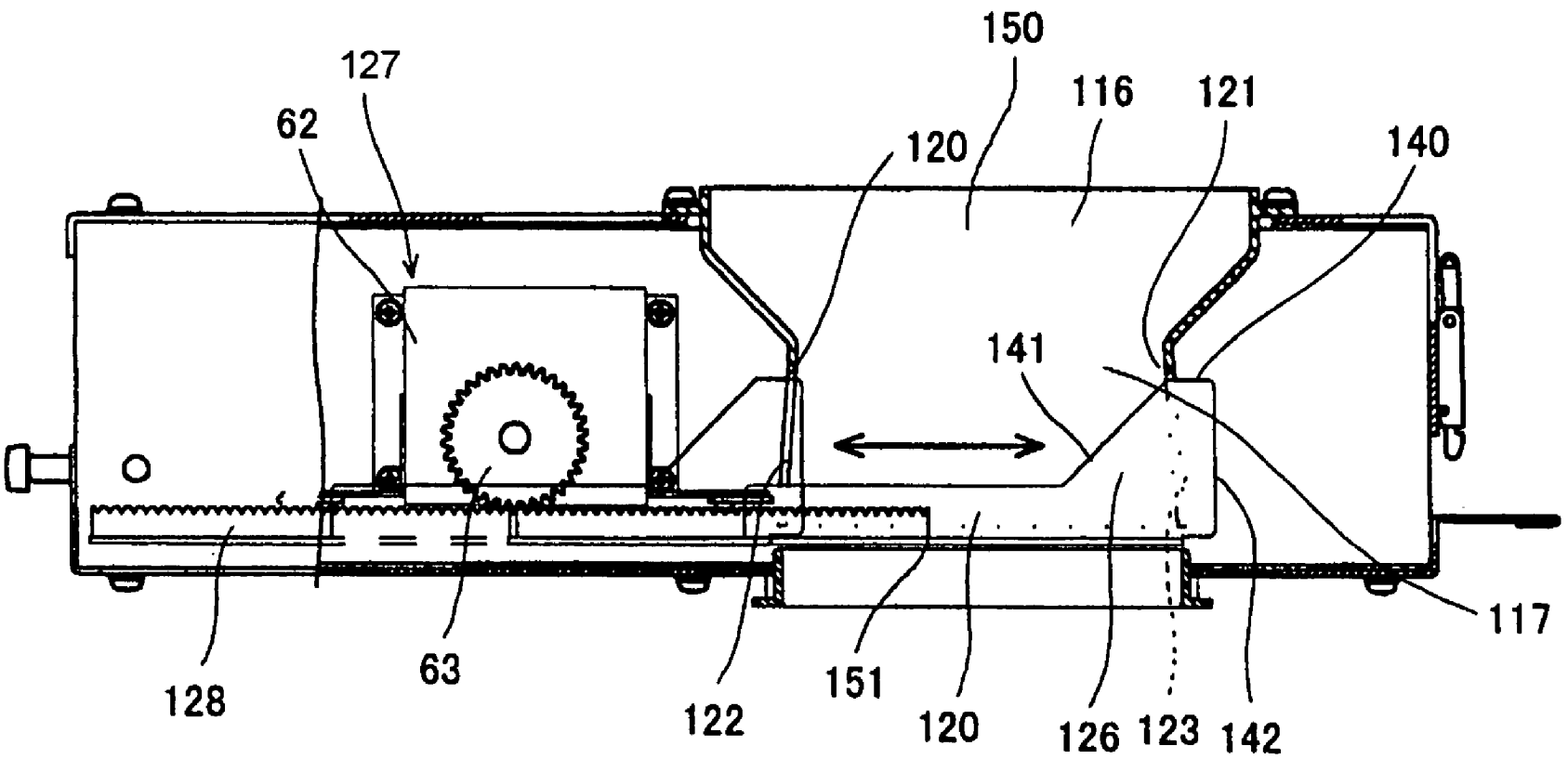
FIG. 29 is a cross-sectional view of the drug dispenser shown in FIG. 28 as seen from its side.
Figure 30:
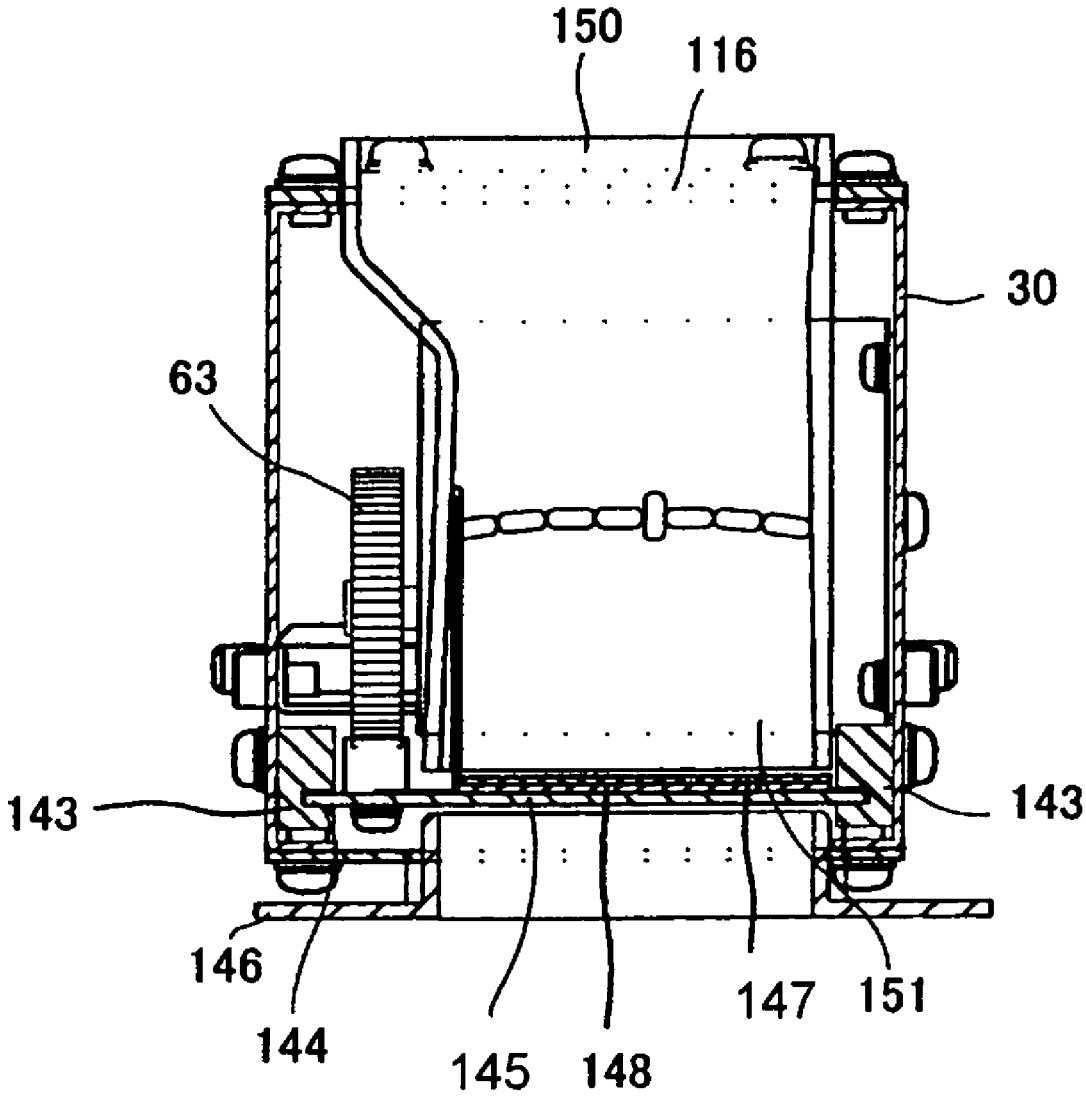
FIG. 30 is a cross-sectional view as taken along A-A of FIG. 28.
Figure 31:
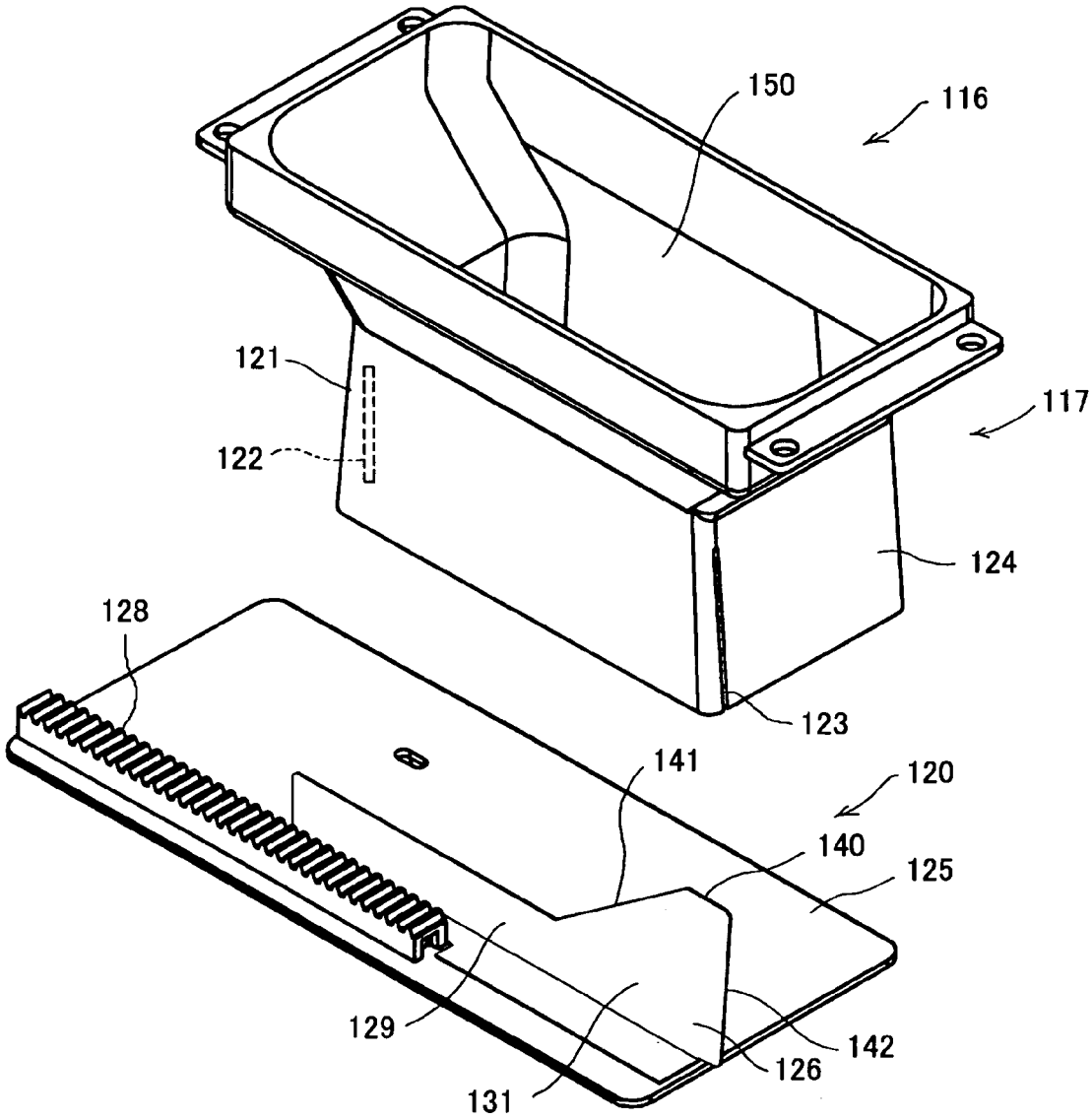
FIG. 31 is a perspective view of a receptacle and a closing member of the drug dispenser shown in FIG. 28.

FIG. 28 is a perspective view of a drug dispenser in a further embodiment of the invention as seen from its proximal end. FIG. 29 is a cross-sectional view of the drug dispenser shown in FIG. 28 as seen from its side. FIG. 30 is a cross-sectional view as taken along A-A of FIG. 28. FIG. 31 is a perspective view of a receptacle and a closing member of the drug dispenser shown in FIG. 28.

In a drug dispenser shown in FIG. 28, a receptacle 116, which has openings 150 and 151 at its top and bottom as well as the foregoing embodiments, has a main body 117 of a substantially cuboidal shape, instead of a drum shape in the foregoing embodiments. The receptacle 116 has a large expansion of dimensions around the top opening 150.

The main body 117 of the receptacle 116 is substantially rectangular as described above and has four faces except top and bottom face covered with walls, front and rear walls 121 and 124 forming narrow sides having slits 122 and 123 respectively. The slits 122 and 123 are formed at one side and the same side of the front and rear walls 121 and 124, extending vertically, and are open at their bottom ends.

In the present embodiment, a closing member 120 is a shutter. The closing member 120 is independent of the receptacle 116 and has a substantially plate-like main body 125 with a rack 128 and a scraper 126 formed thereon.

The main body 125 is considerably larger than the bottom opening 151 of the receptacle 116 described above and substantially rectangular.

The main body 125 may be formed straight out of a thin steel plate, but in the present embodiment, it is formed by a steel layer 145 with a cushion layer 148 made of a material such as urethane resin on its upper surface and a low frictional resin layer 147 further on the upper surface of the cushion layer 141.

The rack 128 is disposed on the upper surface of, adjacent to the end of, and along the longer side of the main body 125 and has a length of about 70% of total length of the main body 125.

In the present embodiment, the closing member 120 has the scraper 126 at a part thereof. The scraper 126 is a thin wall and vertically stands from the above-mentioned plate-like main body 125.

The scraper 126 includes a low wall-like portion 129 and a trapezoid body 131 continuing therefrom. As shown in FIGS. 29 and 31, the trapezoid body 131 has a vertical trapezoidal shape with an upper side 140, a sloping side 141, and a vertical side 142.

The scraper 126 is positioned along one longer side of the receptacle 125, with its total length in conformity with the total length of the main body 117 of the receptacle 116 described above.

The trapezoid body 131 of the scraper 126 is shorter than the main body 117 and is positioned adjacent to one shorter side of the closing member 120.

In a plan view of the closing member 120, the scraper 126 is linearly and extends in parallel with the longer sides of the main body 125.

In the present embodiment, the closing member 120 is independent of the receptacle 116 and is slidably attached to the bottom of the casing 30.

Specifically, as shown in FIG. 30, a guiding member 143 is provided adjacent to the bottom in the casing 30 along the longer side. The guiding member 143 is an elongated body having a slit 144 at its center, the slit 144 extending in a longitudinal direction.

The both ends of the main body 125 of the closing member 120 are inserted into the slit 144 of the guiding member 143, so that the closing member 120 is slidably supported by the guiding member 143 at its both sides.

In the drug dispenser in the present embodiment, the receptacle 116 has a driving section 127 at its side face. The driving section 127 is constituted by a geared motor 62 to which a driving gear 63 is attached, as well as the foregoing embodiment. The driving gear 63 of the driving section 127 is engaged with the rack 128 of the closing member 120 described above. Thus, rotation of the geared motor 62 of the driving section 127 to make the rack 128 engaged therewith to move in a straight line, thereby sliding the closing member 120.

In the drug dispenser in the present embodiment, the closing member 120 and the receptacle 116 are independent each other, the receptacle 116 being mounted on the closing member 120. A connecting guide 146 is disposed below the closing member 120 and at a part corresponding to the bottom opening 151 of the receptacle 116. The connecting guide 146 connects the bottom opening 151 of the receptacle 116 and the moving hopper (a component of the conveyor) so as to protect tablets from spilling out.

In the drug dispenser in the present embodiment, when the closing member 120 exists at the most advanced position, the main body 117 of the closing member 120 corresponds to the bottom opening 151 of the receptacle 116 so as to close the opening 151. At this time, most part of the trapezoid body 131 of the scraper 126 provided at the closing member 120, as shown in FIG. 29, goes in the slit 123 of the receptacle 116.

Then, rotation of the geared motor 62 of the driving section 130 makes a linear movement of the rack 128 as described above to slide the closing member 120, thereby gradually opening the bottom opening 151 of the receptacle 116. Lastly, the closing member 120 leaves the bottom opening 151 to entirely open it.

In this way, in sliding of the closing member 120, the trapezoid body 131 of the scraper 126 scrapes adjacent to the inner surface of the receptacle 116.

Specifically, sliding of the closing member advances the trapezoid body 131 with the sloping side 141 facing forward to cross within the receptacle 116, leading to the slit at the other side.

Thus, the scraper 126 scrapes part of a bridge of tablets to break the bridge. Further, in the present embodiment, as the scraper 126 has the sloping side 141 and advances with the sloping side 141 facing forward, vertical component of force is generated when the sloping side 141 comes in contact with a bridge so as to break the bridge in such a way as scooping up tablets. Therefore, weak force is enough to break a bridge, thereby hardly causing damage to tablets.

The present embodiment also breaks the bridge so that tablets which have entered the drug dispenser are all discharged to the next process without any piece being caught.

The invention claimed is:

1. A drug dispenser to be positioned downstream of a drug feeder, the drug dispenser being adapted to receive solid drugs from the drug feeder, to temporarily accumulate the drugs, and to discharge the accumulated drugs, the drug dispenser comprising:

a receptacle having an open top and a bottom adapted to be opened and closed, said receptacle including an outer receptacle portion and an inner receptacle portion, wherein said inner receptacle portion includes a first movable wall, a second movable wall, and a peripheral wall connecting said first movable wall and said second movable wall, each of said first movable wall, said peripheral wall, and said second movable wall being adapted to move when the bottom of said receptacle is opened, wherein said first movable wall opposes said second movable wall, wherein said inner receptacle portion is rotatably disposed in said outer receptacle portion such that a cavity is formed in said receptacle for accumulating drugs therein, wherein said outer receptacle portion includes an arcuate surface, a first opening formed in said arcuate surface at a top of said outer receptacle portion, and a second opening formed in said arcuate surface at a bottom of said outer receptacle portion, wherein said outer receptacle portion has an expanded portion extending below said second opening, said expanded portion forming a skirt-like portion which expands in a direction extending away from said second opening for preventing tablets or capsules from sticking in said receptacle, wherein said inner receptacle portion has an opening formed in said peripheral wall, said opening extending from said first movable wall to said second movable wall, and wherein the central angle defined by the edges of the opening in said peripheral wall of said inner receptacle portion is greater than the central angle defined by the edges of said first opening of said outer receptacle portion.

2. The drug dispenser as defined in claim 1, wherein each of said first movable wall and said second movable wall is adapted to rotate and has an arcuate portion.

3. The drug dispenser as defined in claim 1, wherein the first movable wall and second movable wall are provided around a position where the drugs are expected to be accumulated.

4. The drug dispenser as defined in claim 1, wherein the outer receptacle portion includes an opening at each of a top and a bottom thereof, and wherein the inner receptacle portion includes an opening at one end thereof and a closure at the other end opposite to the one end, the inner receptacle portion being invertible within the outer receptacle portion.

5. The drug dispenser as defined in claim 1, wherein the outer receptacle portion includes an arcuate portion at the inner surface thereof and includes an opening at each of a top and a bottom thereof, and wherein the inner receptacle portion has an outer surface in substantially conformity with the arcuate portion of the inner surface of the outer receptacle portion, the outer surface of the inner receptacle portion having an opening formed at a part thereof, and wherein the inner receptacle portion is rotatable within the outer receptacle portion such that the outer surface of the inner receptacle portion closes the opening at the bottom of the outer receptacle portion when the inner receptacle portion is at a predetermined angular position and such that the opening of the inner receptacle portion is in conformity with the opening of the outer receptacle portion when the inner receptacle portion is at another predetermined angular position.

6. The drug dispenser as defined in claim 1, wherein the outer receptacle portion includes an arcuate portion at the inner surface thereof and includes an opening at each of a top and a bottom thereof, wherein the inner receptacle portion has an outer surface in substantial conformity with the arcuate inner surface of the outer receptacle portion, the outer surface of the inner receptacle portion having an opening formed at a part thereof, and wherein the inner receptacle portion is rotatable within the outer receptacle portion such that the inner receptacle portion is adapted to make at least one and a half rotations in discharging the drugs.

7. A drug filling apparatus comprising:

a drug supplying section provided with a plurality of drug feeders adapted to send out solid drugs;

the drug dispenser as defined in claim 1 adapted to temporarily accumulate the drugs sent out from the drug feeder and to discharge the accumulated drugs; and a drug filling section adapted to fill the drugs discharged from the drug dispenser into a predetermined container or wrapping material.

8. A drug filling apparatus comprising:

a plurality of drug feeders vertically and horizontally arranged in a matrix;

a plurality of common passageways each corresponding to at least one column of the drug feeders;

the drug dispenser as defined in claim 1 positioned downstream of each of the common passageways; and a drug filling section adapted to fill the drugs discharged from the drug dispenser.

9. The drug dispenser as defined in claim 1, wherein said first movable wall is concentric with said second movable wall.

10. The drug dispenser as defined in claim 1, wherein a cross section of said inner receptacle portion is a partial circle, the peripheral wall is arcuate and constitutes the circumference of the partial circle, and the central angle of the inner receptacle portion is formed between a center of the partial circle and the edges of the opening in the peripheral wall, and wherein a cross section of the arcuate surface of the outer receptacle portion is a partial circle, and the central angle of the outer receptacle portion is formed between a center of the partial circle of the arcuate surface and the edges of the first opening of the outer receptacle portion.

11. A drug dispenser to be positioned downstream of a drug feeder, the drug dispenser being adapted to receive solid drugs from the drug feeder, to temporarily accumulate the drugs, and to discharge the accumulated drugs, the drug dispenser comprising:

a receptacle having an inner peripheral surface, an open top and a bottom adapted to be opened and closed, a casing accommodating the receptacle;

an engaging portion normally protruding from and capable of being retracted into the casing; and a pressing portion for retracting the engaging portion into the casing such that the engaging portion is retracted into the casing when the pressing portion is pressed, wherein at least part of the inner peripheral surface of the receptacle is formed by a movable wall adapted to move when the bottom of the receptacle is opened.

12. A drug dispenser to be positioned downstream of a drug feeder, the drug dispenser being adapted to receive solid drugs from the drug feeder, to temporarily accumulate the drugs, and to discharge the accumulated drugs, the drug dispenser comprising:

a receptacle having an opening at each of a top and a bottom thereof;

a closing member for opening and closing the opening at the bottom of the receptacle;

a scraper adapted to scrape a part of an inner surface of the receptacle or a vicinity of the part when the closing member opens the opening at the bottom of the receptacle;

a casing accommodating the receptacle;

an engaging portion normally protruding from and capable of being retracted into the casing; and a pressing portion for retracting the engaging portion into the casing such that the engaging portion is retracted into the casing when the pressing portion is pressed;

wherein said scraper and said closing member are discrete structures, said scraper extending away from said closing member.

13. The drug dispenser as defined in claim 12, wherein the receptacle comprises an outer receptacle portion and an inner receptacle portion accommodated in the outer receptacle portion, wherein the outer receptacle portion includes an opening at each of a top and a bottom thereof, and wherein the inner receptacle portion has an opening at one end thereof and is closed at the other end opposite to the opening, the inner receptacle portion including the closing member for opening and closing the opening at the bottom thereof, and including the scraper, the scraper being adapted to scrape the inner surface of the outer receptacle portion in accordance with rotation of the inner receptacle portion.

14. The drug dispenser as defined in claim 12, wherein the scraper has a non-circular shape and is adapted to rotate along the inner surface of the outer receptacle portion.

15. The drug dispenser as defined in claim 12, wherein the receptacle comprises an outer receptacle portion and an inner receptacle portion accommodated in the outer receptacle portion, wherein the outer receptacle portion includes an opening at each of a top and a bottom thereof, and wherein the inner receptacle portion is rotatable within the outer receptacle portion and has an opening at one end thereof and is closed at the other end opposite to the opening, the inner receptacle portion including the closing member for opening and closing the opening at the bottom of the outer receptacle portion, and including the scraper, the scraper having an arm shape and being rotatable along the inner surface of the outer receptacle portion.

16. A drug filling apparatus comprising:

a drug supplying section provided with a plurality of drug feeders that are adapted to send out solid drugs;

the drug dispenser as defined in claim 12 adapted to temporarily accumulate the drugs sent out from the drug feeder and to discharge the accumulated drugs; and a drug filling section adapted to fill the drugs discharged from the drug dispenser into a predetermined container or wrapping material.

17. A drug filling apparatus comprising:

a plurality of drug feeders vertically and horizontally arranged in a matrix;

a plurality of common passageways each corresponding to at least one column of the drug feeders;

the drug dispenser as defined in claim 12 positioned downstream of each of the common passageways; and a drug filling section adapted to fill the drugs discharged from the drug dispenser.

18. A drug dispenser to be positioned downstream of a drug feeder, the drug dispenser being adapted to receive solid drugs from the drug feeder, to temporarily accumulate the drugs, and to discharge the accumulated drugs, the drug dispenser comprising:

a receptacle having an opening at each of a top and a bottom thereof;

a closing member for opening and closing the opening at the bottom of the receptacle; and a scraper adapted to scrape a part of an inner surface of the receptacle or a vicinity of the part when the closing member opens the opening at the bottom of the receptacle, wherein the closing member is a linearly movable shutter, and wherein the scraper is integrated with the closing member.

19. The drug dispenser of claim 12, wherein said scraper and said closing member are rotatable about an axis of rotation, and wherein said scraper extends away from said closing member in a direction perpendicular to the axis of rotation of rotation.

20. The drug dispenser as defined in claim 18, wherein the receptacle has a substantially rectangular inner shape with longer sides and shorter sides as seen in a plan sectional view, the inner peripheral surface comprising a plurality of faces, at least one of the faces that form the longer sides being the closing member.

21. A drug dispenser to be positioned downstream of a drug feeder, the drug dispenser being adapted to receive solid drugs from the drug feeder, to temporarily accumulate the drugs, and to discharge the accumulated drugs, the drug dispenser comprising:

a receptacle having an opening at either of its top and bottom;

a closing member for opening and closing the opening at the bottom of the receptacle; and a scraper adapted to cross within the receptacle when the closing member opens the opening at the bottom of the receptacle, wherein the closing member is a linearly movable shutter and wherein the scraper is integrated with the closing member.

22. The drug dispenser as defined in claim 21, the scraper having a sloping side so as to cross within the receptacle with the sloping side facing forward in accordance with a linear movement of the closing member.

23. The drug dispenser as defined in claim 21, further comprising:

a casing accommodating the receptacle;

an engaging portion normally protruding from and capable of being retracted into the casing; and a pressing portion for retracting the engaging portion into the casing such that the engaging portion is retracted into the casing when the pressing portion is pressed.

24. A drug filling apparatus comprising:

a drug supplying section provided with a plurality of drug feeders that are adapted to send out solid drugs;

the drug dispenser as defined in claim 21 adapted to temporarily accumulate the drugs sent out from the drug feeder and to discharge the accumulated drugs; and a drug filling section adapted to fill the drugs discharged from the drug dispenser into a predetermined container or wrapping material.

25. A drug filling apparatus comprising:

a main body;

a plurality of drug feeders adapted to send out solid drugs and arranged vertically and horizontally in a matrix in the main body;

a plurality of common passageways each corresponding to at least one column of the drug feeders;

a drug dispenser positioned downstream of each of the common passageways, the drug dispenser being adapted to receive solid drugs from the drug feeder, to temporarily accumulate the drugs, and to discharge the accumulated drugs through its predetermined opening; and a drug filling section adapted to fill the drugs discharged from the drug dispenser into a predetermined container or wrapping material, wherein the drug dispenser comprises a receptacle, a power source and a casing accommodating the receptacle and the power source integrally, the receptacle being adapted to accumulate the drugs, the power source being adapted to open an opening of the receptacle, wherein the drug dispenser further comprises an engaging portion normally protruding from and capable of being retracted into the casing, and a pressing portion for retracting the engaging portion into the casing such that the engaging portion is retracted into the casing when the pressing portion is pressed, and wherein the main body has a plurality of compartments for installing the casing of the drug dispenser therein, each compartment having an engaging hole or a slot for engaging the engaging portion of the drug dispenser, the drug dispenser being insertable into the compartment with the pressing portion of the drug dispenser pressed to make the engaging portion refracted into the casing, the engaging portion being engaged with the engaging hole or the slot formed in the compartment when the drug dispenser is inserted into the compartment.

26. The drug filling apparatus as defined in claim 25, wherein the casing has a casing connector at its distal end and the main body has a main body connector in the compartment thereof, and wherein the engagement hole or the slot extends in a longitudinal direction of the casing such that the casing connector and the main body connector are connected by sliding the casing with the engaging portion engaged with the engaging hole or the slot in the compartment.

* * * * *